US007252362B2

(12) United States Patent
Katsu et al.

(10) Patent No.: US 7,252,362 B2
(45) Date of Patent: Aug. 7, 2007

(54) PRINTING APPARATUS, CONTROL METHOD THEREFOR, PRINTHEAD CONTROL CIRCUIT, AND PRINTHEAD DRIVING METHOD

(75) Inventors: Takuji Katsu, Kanagawa-ken (JP); Toru Nakayama, Kanagawa-ken (JP); Yuji Hamasaki, Kanagawa-ken (JP); Norihiro Kawatoko, Kanagawa-ken (JP); Atsushi Sakamoto, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 220 days.

(21) Appl. No.: 11/002,949

(22) Filed: Dec. 3, 2004

(65) Prior Publication Data

US 2005/0122373 A1 Jun. 9, 2005

(30) Foreign Application Priority Data

Dec. 9, 2003 (JP) ..... 2003-410770

(51) Int. Cl.
*B41J 2/165* (2006.01)

(52) U.S. Cl. ..... 347/22; 347/23

(58) Field of Classification Search ..... 347/22, 347/23–35
See application file for complete search history.

(56) References Cited

U.S. PATENT DOCUMENTS

| | | | | |
|---|---|---|---|---|
| 5,343,228 | A * | 8/1994 | Takada | 347/29 |
| 5,774,145 | A | 6/1998 | Morita et al. | |
| 5,805,182 | A * | 9/1998 | Lee | 347/35 |
| 6,637,865 | B1 | 10/2003 | Murakami et al. | |
| 6,854,820 | B2 | 2/2005 | Murakami et al. | |

FOREIGN PATENT DOCUMENTS

| | | |
|---|---|---|
| JP | 8-295033 | 11/1996 |
| JP | 2000-71433 | 7/2000 |
| JP | 2001-129997 | 5/2001 |

OTHER PUBLICATIONS

Counterpart U.S. Patent also cited.

* cited by examiner

*Primary Examiner*—Stephen Meier
*Assistant Examiner*—Ly T. Tran
(74) *Attorney, Agent, or Firm*—Fitzpatrick, Cella, Harper & Scinto

(57) ABSTRACT

A printing apparatus having a printhead for printing by discharging liquid on a printing medium performs a toggle preliminary discharge operation of alternately performing discharge from main nozzles and dummy nozzles in order to establish a good discharge state of the liquid from the main nozzles. The main nozzles and the dummy nozzles communicate with liquid chambers, which in turn communicate with a common liquid chamber. A control circuit for the printhead and a control method are also provided.

14 Claims, 22 Drawing Sheets

FIG. 11

| BK_DATA(even) | CORRESPONDING NOZZLE | COLOR_DATA(even) | CORRESPONDING NOZZLE |
|---|---|---|---|
| NZL_D[ 9: 0] BE0 | {288,256,224,192,160,128, 96,64,32, 0} | NZL_D[ 3: 0] BE0 | { 96,64,32, 0} |
| NZL_D[ 19: 10] BE1 | {290,258,226,194,162,130, 98,66,34, 2} | NZL_D[ 13: 10] BE1 | { 98,66,34, 2} |
| NZL_D[ 29: 20] BE2 | {292,290,228,196,164,132,100,68,36, 4} | NZL_D[ 23: 20] BE2 | {100,68,36, 4} |
| NZL_D[ 39: 30] BE3 | {294,262,230,198,166,134,104,70,38, 6} | NZL_D[ 33: 30] BE3 | {102,70,38, 6} |
| NZL_D[ 49: 40] BE4 | {296,264,232,200,168,136,104,72,40, 8} | NZL_D[ 43: 40] BE4 | {104,72,40, 8} |
| NZL_D[ 59: 50] BE5 | {298,266,234,202,170,138,106,74,42,10} | NZL_D[ 53: 50] BE5 | {106,74,42,10} |
| NZL_D[ 69: 60] BE6 | {300,268,236,204,172,140,108,76,44,12} | NZL_D[ 63: 60] BE6 | {108,76,44,12} |
| NZL_D[ 79: 70] BE7 | {302,270,238,206,174,142,110,78,46,14} | NZL_D[ 73: 70] BE7 | {110,78,46,14} |
| NZL_D[ 89: 80] BE8 | {304,272,240,208,176,144,112,80,48,16} | NZL_D[ 83: 80] BE8 | {112,80,48,16} |
| NZL_D[ 99: 90] BE9 | {306,274,242,210,178,146,114,82,50,18} | NZL_D[ 93: 90] BE9 | {114,82,50,18} |
| NZL_D[109:100] BE10 | {308,276,244,212,180,148,116,84,52,20} | NZL_D[103:100] BE10 | {116,84,52,20} |
| NZL_D[119:110] BE11 | {310,278,246,214,182,150,118,86,54,22} | NZL_D[113:110] BE11 | {118,86,54,22} |
| NZL_D[129:120] BE12 | {312,280,248,216,184,152,120,88,56,24} | NZL_D[123:120] BE12 | {120,88,56,24} |
| NZL_D[139:130] BE13 | {314,282,250,218,186,154,122,90,58,26} | NZL_D[133:130] BE13 | {122,90,58,26} |
| NZL_D[149:140] BE14 | {316,284,252,220,188,156,124,92,60,28} | NZL_D[143:140] BE14 | {124,92,60,28} |
| NZL_D[159:150] BE15 | {318,286,254,222,190,158,126,94,62,30} | NZL_D[153:150] BE15 | {126,94,62,30} |

FIG. 16

| H_ENB1 | H_ENB2 | BLE | BE4(L/S) | NOZZLE | | | | BE4(L/S) | BLE | H_ENB1 | H_ENB2 |
|---|---|---|---|---|---|---|---|---|---|---|---|
| × | L | 14 | 0 | DH0A | | | DH0B | 1 | 14 | × | L |
| × | L | 14 | 1 | DH1B | | | DH1A | 0 | 14 | × | L |
| × | L | 15 | 0 | DH2A | | | DH2B | 1 | 15 | × | L |
| × | L | 15 | 1 | DH3B | | | DH3A | 0 | 15 | × | L |
| L | × | 0 | 0 | 0A | | | 0B | 1 | 0 | L | × |
| L | × | 0 | 1 | 1B | | | 1A | 0 | 0 | L | × |
| ⋮ | ⋮ | ⋮ | ⋮ | ⋮ | | | ⋮ | ⋮ | ⋮ | ⋮ | ⋮ |
| × | L | 15 | 0 | 126A | | | 126B | 1 | 15 | × | L |
| × | L | 15 | 1 | 127B | | | 127A | 0 | 15 | × | L |
| L | × | 0 | 0 | DH4A | | | DH4B | 1 | 0 | L | × |
| L | × | 0 | 1 | DH5B | | | DH5A | 0 | 0 | L | × |
| L | × | 1 | 0 | DH6A | | | DH6B | 1 | 1 | L | × |
| L | × | 1 | 1 | DH7B | | | DH7A | 0 | 1 | L | × |

FIG. 18

| MODE | BLACK PRELIMINARY DISCHARGE COUNT | COLOR PRELIMINARY DISCHARGE COUNT | DRIVING FREQUENCY | TIMING |
|---|---|---|---|---|
| ⋮ | ⋮ | ⋮ | ⋮ | ⋮ |
| PRELIMINARY DISCHARGE I | 1000 | 1000 | BLACK : 5kHz<br>COLOR : 10kHz | AFTER WIPING |
| ⋮ | ⋮ | ⋮ | ⋮ | ⋮ |
| PRELIMINARY DISCHARGE J | 2000 | 3000 | BLACK : 5kHz<br>COLOR : 10kHz | AFTER CLEANING |
| ⋮ | ⋮ | ⋮ | ⋮ | ⋮ |
| PRELIMINARY DISCHARGE K | 1000 | 1000 | BLACK : 5kHz<br>COLOR : 10kHz | AFTER CLEANING |
| ⋮ | ⋮ | ⋮ | ⋮ | ⋮ |
| PRELIMINARY DISCHARGE L | 100 | 100 | BLACK : 5kHz<br>COLOR : 13kHz | DURING PRINTING |
| ⋮ | ⋮ | ⋮ | ⋮ | ⋮ |

FIG. 19

```
--Cange Synchronous 3.27.2003
  process(CLK,RESX,ENB_YOBI_COLOR_TGL,DTARANS_YOBI_COLOR_TGL
  _FLG,L_2_NZL_BUF_DT_C1,L_2_NZL_BUF_DT_M1,L_2NZL_BUF_DT_Y1,
    L_2_NZL_BUF_DT_Y2,L_2_NZL_BUF_DT_M2,L_2_NZL_BUF_DT
    _C2,DUMMY_HEAT) begin
    if(CLK' event and CLK='1') then
      if(RESX='0') then
        L_3_NZL_BUF_DT_C1 <= "0000";
        L_3_NZL_BUF_DT_M1 <= "0000";
        L_3_NZL_BUF_DT_Y1 <= "0000";
        L_3_NZL_BUF_DT_Y2 <= "0000";
        L_3_NZL_BUF_DT_M2 <= "0000";
        L_3_NZL_BUF_DT_C2 <= "0000";
        L_DUMMY_HEAT(1) <= '0';
      elsif(ENB_YOBI_COLOR_TGL = '1') then
          --+ Enable Toggle Yobito (Main Nozzle and Dummy Nozzle)  +--
          if(I)TARANS_YOBI_COLOR_TGL_FLG ='1') then
            --+ In Case of Main Nozzle +--
            L_3_NZL_BUF_DT_C1 <= L_2_NZL_BUF_DT_C1;
            L_3_NZL_BUF_DT_M1 <= L_2_NZL_BUF_DT_M1;
            L_3_NZL_BUF_DT_Y1 <= L_2_NZL_BUF_DT_Y1;
            L_3_NZL_BUF_DT_Y2 <= L_2_NZL_BUF_DT_Y2;
            L_3_NZL_BUF_DT_M2 <= L_2_NZL_BUF_DT_M2;
            L_3_NZL_BUF_DT_C2 <= L_2_NZL_BUF_DT_C2;
            L_DUMMY_HEAT(1) <= '0';          -- select Main Nozzle
          else     --+ In Case of Main Nozzle +--
            L_3_NZL_BUF_DT_C1 <= "0000";   -- Set Zero data
            L_3_NZL_BUF_DT_M1 <= "0000";   -- Set Zero data
            L_3_NZL_BUF_DT_Y1 <= "0000";   -- Set Zero data
            L_3_NZL_BUF_DT_Y2 <= "0000";   -- Set Zero data
            L_3_NZL_BUF_DT_M2 <= "0000";   -- Set Zero data
            L_3_NZL_BUF_DT_C2 <= "0000";   -- Set Zero data
            L_DUMMY_HEAT(1) <= '1';          --Select Dummy Nozzle
          end if;
      else     --+ Disable Toggle Yobito (Normal Printing , Yobito Mode)  +--
            L_3_NZL_BUF_DT_C1 <= L_2_NZL_BUF_DT_C1;
            L_3_NZL_BUF_DT_M1 <= L_2_NZL_BUF_DT_M1;
            L_3_NZL_BUF_DT_Y1 <= L_2_NZL_BUF_DT_Y1;
            L_3_NZL_BUF_DT_Y2 <= L_2_NZL_BUF_DT_Y2;
            L_3_NZL_BUF_DT_M2 <= L_2_NZL_BUF_DT_M2;
            L_3_NZL_BUF_DT_C2 <= L_2_NZL_BUF_DT_C2;
            L_DUMMY_HEAT(1) <= DUMMY_HEAT(1);
      end if;
    end if;
  end process;
-- Generate Color Nozzle Data
  C1_PDATA  <= "000000" & L_3_NZL_BUF_DT_C1 & L_4_BLK_SEL_C1
  & L_S_FLG & L_DUMMY_HEAT(1) ; --Cyan   EVEN
  M1_PDATA  <= "000000" & L_3_NZL_BUF_DT_M1 & L_4_BLK_SEL_M1
  & L_S_FLG & L_DUMMY_HEAT(1) ; --Magenta EVEN
  Y1_PDATA  <= "000000" & L_3_NZL_BUF_DT_Y1 & L_4_BLK_SEL_Y1
  & L_S_FLG & L_DUMMY_HEAT(1) ; --Yellow  EVEN
  C2_PDATA  <= "000000" & L_3_NZL_BUF_DT_C2 & L_4_BLK_SEL_C2
  & L_S_FLG & L_DUMMY_HEAT(1) ; --Cyan   ODD
  M2_PDATA  <= "000000" & L_3_NZL_BUF_DT_M2 & L_4_BLK_SEL_M2
  & L_S_FLG & L_DUMMY_HEAT(1) ; --Magenta ODD
  Y2_PDATA  <= "000000" & L_3_NZL_BUF_DT_Y2 & L_4_BLK_SEL_Y2
  & L_S_FLG & L_DUMMY_HEAT(1) ; --Yellow  ODD
```

62

63

59 TOGGLE PRELIMINARY DISCHARGE

60 MAIN NOZZLE

61 DUMMY NOZZLE

64 TOGGLE PRELIMINARY DISCHARGE

65 COLOR NOZZLE

FIG. 20

ADDRESS: B000 | NAME OF REGISTER: DTRANS_LDX(41) | NAME OF BLOCK: HEAD

[FUNCTIONAL OUTLINE (Function)] SETTING OF TOGGLE PRELIMINARY DISCHARGE BY MAIN AND DUMMY NOZZLES

| 15 | | | | 11 | | | | 7 | | | | 3 | | | 0 |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 3 | 3 |

0:NOT USED 1:READ ONLY 2:WRITE ONLY 3:W/R

| BIT | FUNCTION | | W/R | at RESET |
|---|---|---|---|---|
| 0 | SETTING OF WHETHER TO EXECUTE TOGGLE PRELIMINARY DISCHARGE BY BK MAIN AND DUMMY NOZZLES | 0:NO NO TOGGLE<br>1:EXECUTE TOGGLE | W/R | 0 |
| 1 | SETTING OF WHETHER TO EXECUTE TOGGLE PRELIMINARY DISCHARGE BY COLOR MAIN AND DUMMY NOZZLES | 0:NO NO TOGGLE<br>1:EXECUTE TOGGLE | W/R | 0 |

PRINTING APPARATUS, CONTROL METHOD THEREFOR, PRINTHEAD CONTROL CIRCUIT, AND PRINTHEAD DRIVING METHOD

FIELD OF THE INVENTION

The present invention relates to a printing apparatus which drives and controls a printhead for discharging a liquid from main nozzles and printing on a printing medium, a printing apparatus control method, a printhead control circuit, and a printhead driving method in a printhead having a common liquid chamber which receives a liquid, a plurality of main nozzles which align at a predetermined interval on the two sides of the common liquid chamber along the longitudinal direction of the common liquid chamber and used for printing, a plurality of dummy nozzles which align on the two sides of the main nozzles along their array direction and are not used for printing, and a plurality of liquid chambers which communicate with the common liquid chamber while the main and dummy nozzles are open in the liquid chambers.

BACKGROUND OF THE INVENTION

With recent development of personal computers, the technique of printing apparatuses has also abruptly advanced. The printing apparatus prints an image on a printing sheet on the basis of image information.

These days, the most attention-getting printing method of the printing apparatus is an inkjet printing method. According to the inkjet printing method, ink is discharged from a printhead onto a printing sheet to print. As the advantages of this method, a high-resolution image can be printed at a high speed, and the inkjet printing method is superior to other printing methods in various aspects such as the running cost and quietness.

There is known a method using an electrothermal transducer which generates thermal energy as ink droplet discharge energy of the inkjet printing method. According to this method, small ink droplets are discharged from small nozzles arranged in an inkjet printhead, thereby printing on a printing medium such as a paper sheet.

Generally in an inkjet printhead using an electrothermal transducer formed from a driving system for forming ink droplets and a supply system for supplying ink to the driving system, the electrothermal transducer is arranged in a pressure chamber, and an electrical pulse serving as printing data is supplied to apply thermal energy to ink. An abrupt phase change in ink at this time, i.e., a bubble pressure generated by gasification is utilized to discharge ink droplets.

The structure of a general inkjet printhead will be described with reference to FIG. 2.

FIG. 2 is a perspective view showing the outer appearance of a general inkjet printhead.

In FIG. 2, the inkjet printhead has nozzle arrays for discharging inks of a plurality of colors. Reference numeral 1 denotes a black (Bk) nozzle array for discharging black ink; 2, a cyan (C) nozzle array for discharging cyan ink; 3, a yellow (Y) nozzle array for discharging yellow ink; and 4, a magenta (M) nozzle array for discharging magenta ink.

The detailed structure of each nozzle array will be explained with reference to FIG. 3.

FIG. 3 is a view showing the layout of the nozzle array of the inkjet printhead.

As shown in FIG. 3, the mainstream of the inkjet printhead is a printhead having a staggered nozzle layout. In FIG. 3, printing main nozzles include 320 black (Bk) nozzles and 128 color (COLOR) nozzles (for each color) (FIG. 3 illustrates nozzles for one of cyan, magenta, and yellow).

The nozzle array of each color is formed from two arrays. In the nozzle array of each color, the left side of FIG. 3 is an EVEN nozzle array, and the right side is an ODD nozzle array.

Each of the EVEN and ODD nozzle arrays has 160 nozzles for black and 64 nozzles for each color.

The positional relationship between nozzles is designed so that two nozzle arrays of the same color each prepared by arraying many nozzles at a predetermined pitch py in the y direction (sub-scanning direction) are spaced apart in the x direction (main scanning direction) by a distance px corresponding to a predetermined number of pixels, and nozzles between the arrays are shifted by (py/2) in the y direction.

The main scanning direction is a direction in which the inkjet printhead is scanned, and the sub-scanning direction is a direction perpendicular to the main scanning direction.

This layout can implement printing at double the resolution of one array by only adjusting the discharge timing between the two nozzle arrays.

The schematic structure of the nozzle array will be explained with reference to FIGS. 4 and 5.

FIG. 4 is a view showing the schematic structure of the nozzle array of the inkjet printhead. FIG. 5 is a sectional view showing the sectional structure of the nozzle array in FIG. 4 taken along the X direction.

Especially, FIG. 4 illustrates the schematic structure of the nozzle array of an inkjet printhead which discharges ink of a predetermined color. In FIG. 4, the nozzle array is formed from a plurality of main nozzles 5 which discharge ink, a plurality of ink chambers 6 in which the main nozzles 5 are open, and an elongated common ink chamber 7 which supplies ink to the ink chambers 6.

An inkjet printhead for a color printer comprises a plurality of nozzle arrays, e.g., four nozzle arrays shown in FIG. 4 in correspondence with four color inks of yellow, magenta, cyan, and black in order to print with multicolor ink. In the above-mentioned inkjet printhead, the main nozzles 5 are arranged at an interval as small as possible in order to downsize the apparatus.

Since the inkjet printhead (to be abbreviated as a printhead hereinafter) treats a liquid, it is applied to an inkjet printer having a suction/recovery mechanism which uses a cap and discharges a liquid within the printhead from the printhead as the liquid thickens, and a preliminary discharge mechanism which drives a driving element (preliminary discharge is executed regardless of a print signal and is also called idle discharge), or having a cleaning mechanism which cleans the nozzle surface.

In order to maintain a good state of the main nozzle 5 of the printhead, the inkjet printer executes "cleaning", "head refreshing", and "wiping" as working sequences.

In the first two of these sequences, a negative pressure is applied to the cap which covers the main nozzle 5, and ink in the common ink chamber 7 is sucked to unclog the main nozzle 5. After that, preliminary discharge is performed. By wiping, thickened ink attached to the nozzle surface is removed.

Time-base preliminary discharge is executed at a predetermined time interval even during printing in order to prevent a discharge failure in the next discharge that is caused by thickening of ink in a main nozzle 5 not used for printing upon the lapse of time.

Liquids of different colors or liquids having different characteristics may be mixed between printheads for respective colors regardless of whether nozzle arrays of a plurality of colors are arranged integrally or separately. There are known various means for solving this problem.

Of these means, Japanese Patent Laid-Open No. 8-295033 discloses a technique of preventing color mixing between adjacent printheads by arranging dummy nozzles between them. More specifically, inks from adjacent printheads are guided to the dummy nozzles, and the mixed ink is discharged from the dummy nozzles, thereby removing the mixed ink.

According to Japanese Patent Laid-Open No. 2001-129997, as shown in FIG. 6, some of the main nozzles 5 are used as dummy nozzles 8 along the array direction of the main nozzles 8. Dummy ink chambers 9 of the dummy nozzles 8 communicate with the common ink chamber 7 of the array of the main nozzles 5. In a printhead recovery process, ink staying in the common ink chamber 7 can also be preliminarily discharged from the dummy nozzles 8.

Since bubbles at the two ends of the common ink chamber 7 are discharged from the dummy nozzles 8 together with the liquid, mixed ink can be quickly discharged. In particular, the liquid flow can be promoted between the dummy nozzles 8 and the ends, in the longitudinal direction, of the elongated common ink chamber 7 which receives ink. Thickened ink which tends to stay at the ends of the common ink chamber 7 in the longitudinal direction can be smoothly, reliably discharged outside the printhead from the dummy nozzles 8.

In suction and recovery of the printhead during "cleaning" or "head refreshing" described above, all the nozzle arrays (black, cyan, magenta, and yellow) or the black nozzle array and color nozzle arrays (cyan, magenta, and yellow) are simultaneously sucked through one cap, and all inks are mixed within the cap.

The mixed ink within the cap may be attached to the nozzle surface of the printhead, and after suction operation stops, may be sucked by a negative pressure within the ink tank.

If printing is done in this state, an ink different from an intended one is discharged, greatly degrading the printing quality. In order to prevent this error, mixed ink sucked into the printhead is preliminarily discharged after suction and recovery.

In the common ink chamber 7 shown in FIG. 6, ink tends to stay at the ends in the longitudinal direction because of an elongated structure. To prevent this, preliminary discharge is first performed from the main nozzles 5 used for printing, and then from the dummy nozzles 8 upon the lapse of a predetermined time.

Accordingly, thickened ink at the ends in the longitudinal direction can be discharged from the printhead. As for time-based preliminary discharge during printing, preliminary discharge from the main nozzles 5 used for printing and preliminary discharge from the dummy nozzles 8 are executed.

The state of preliminary discharge by the main nozzles 5 and dummy nozzles 8 will be explained with reference to FIGS. 7A and 7B.

FIGS. 7A and 7B are views schematically showing the state of preliminary discharge.

FIG. 7A shows the state of preliminary discharge from the main nozzles 5, and FIG. 7B shows the state of preliminary discharge from the dummy nozzles 8.

As shown in FIGS. 7A and 7B, when ink is discharged from the main nozzles 5, ink can be satisfactorily discharged from the common ink chamber 7 toward the outlets of the main nozzles, but ink tends to stay at the two ends of the common ink chamber 7. These portions will be called stagnation portions 10.

The stagnation portions 10 readily become sticky owing to stayed ink. To prevent this, ink staying at the stagnation portions 10 is discharged by discharging it from the dummy nozzles 8 after discharge from the main nozzles 5, as shown in FIG. 7B.

As for preliminary discharge, the discharge count for performing discharge is generally equal between the main nozzles 5 and the dummy nozzles 8. Thus, execution of preliminary discharge from the main nozzles 5 used for printing requires preliminary discharge from the dummy nozzles 8 at the same discharge count. A discharge time corresponding to double the preliminary discharge count of the main nozzles is necessary.

As a method of shortening the preliminary discharge time, the discharge frequency of preliminary discharge may be increased. However, the response characteristic of the printhead which performs preliminary discharge is physically limited. The preliminary discharge time cannot be shortened by simply increasing the discharge frequency of preliminary discharge.

SUMMARY OF THE INVENTION

The present invention has been made to overcome the conventional drawbacks, and has as its object to provide a printing apparatus capable of smoothly, reliably discharging, within a short time, ink staying at the stagnation portion of the common ink chamber of a printhead from the nozzles of the printhead, a printing apparatus control method, a printhead control circuit, and a printhead driving method.

According to the present invention, the foregoing object is attained by providing a printing apparatus which drives and controls a printhead for discharging a liquid from main nozzles and printing on a printing medium, the printhead having a common liquid chamber which receives a liquid, a plurality of main nozzles which align at a predetermined interval on two sides of the common liquid chamber along a longitudinal direction of the common liquid chamber and used for printing, a plurality of dummy nozzles which align on two sides of the main nozzles along an array direction of the main nozzles and are not used for printing, and a plurality of liquid chambers which communicate with the common liquid chamber while the main nozzles and the dummy nozzles are open in the liquid chambers, comprising:

preliminary discharge means for performing preliminary discharge from the main nozzles and the dummy nozzles in order to make a good sate of a discharge state of the liquid from the main nozzles;

switching means for alternately switching between the main nozzles and the dummy nozzles every column serving as a driving cycle of all nozzles for the main nozzles and the dummy nozzles; and control means for executing and controlling, as the preliminary discharge operation by the preliminary discharge means, toggle preliminary discharge operation of alternately performing discharge from the main nozzles and the dummy nozzles every column.

In a preferred embodiment, a driving frequency of the toggle preliminary discharge operation is double a preliminary discharge frequency of each of the main nozzle and the dummy nozzle.

In a preferred embodiment, one of the main nozzle and the dummy nozzle can be selected as an end nozzle in the toggle preliminary discharge operation.

In a preferred embodiment, in the toggle preliminary discharge operation, printing data for performing preliminary discharge from the dummy nozzle includes zero data.

In a preferred embodiment, the switching means is implemented by hardware.

In a preferred embodiment, the printhead includes an inkjet printhead which prints by discharging ink.

In a preferred embodiment, the printhead includes a printhead which discharges ink by utilizing thermal energy, and comprises a thermal transducer which generates thermal energy to be applied to ink.

According to the present invention, the foregoing object is attained by providing a method of controlling a printing apparatus which drives and controls a printhead for discharging a liquid from main nozzles and printing on a printing medium, the printhead having a common liquid chamber which receives a liquid, a plurality of main nozzles which align at a predetermined interval on two sides of the common liquid chamber along a longitudinal direction of the common liquid chamber and used for printing, a plurality of dummy nozzles which align on two sides of the main nozzles along an array direction of the main nozzles and are not used for printing, and a plurality of liquid chambers which communicate with the common liquid chamber while the main nozzles and the dummy nozzles are open in the liquid chambers, comprising:

a preliminary discharge step of performing preliminary discharge from the main nozzles and the dummy nozzles in order to make a good state of a discharge state-of the liquid from the main nozzles;

a switching step of alternately switching between the main nozzles and the dummy nozzles every column serving as a driving cycle of all nozzles for the main nozzles and the dummy nozzles; and a control step of executing and controlling, as the preliminary discharge operation in the preliminary discharge step, toggle preliminary discharge operation of alternately performing discharge from the main nozzles and the dummy nozzles every column.

According to the present invention, the foregoing object is attained by providing a control circuit for a printhead for discharging a liquid from main nozzles and printing on a printing medium, the printhead having a common liquid chamber which receives a liquid, a plurality of main nozzles which align at a predetermined interval on two sides of the common liquid chamber along a longitudinal direction of the common liquid chamber and used for printing, a plurality of dummy nozzles which align on two sides of the main nozzles along an array direction of the main nozzles and are not used for printing, and a plurality of liquid chambers which communicate with the common liquid chamber while the main nozzles and the dummy nozzles are open in the liquid chambers, comprising:

switching means for alternately switching between the main nozzles and the dummy nozzles every column serving as a driving cycle of all nozzles for the main nozzles and the dummy nozzles; and control means for executing and controlling toggle preliminary discharge operation of alternately performing discharge from the main nozzles and the dummy nozzles every column, as preliminary discharge operation of performing preliminary discharge from the main nozzles and the dummy nozzles by using the switching means in order to make a good state of a discharge state of the liquid from the main nozzles.

According to the present invention, the foregoing object is attained by providing a method of driving a printhead for discharging a liquid from main nozzles and printing on a printing medium, the printhead having a common liquid chamber which receives a liquid, a plurality of main nozzles which align at a predetermined interval on two sides of the common liquid chamber along a longitudinal direction of the common liquid chamber and used for printing, a plurality of dummy nozzles which align on two sides of the main nozzles along an array direction of the main nozzles and are not used for printing, and a plurality of liquid chambers which communicate with the common liquid chamber while the main nozzles and the dummy nozzles are open in the liquid chambers, comprising:

a switching step of alternately switching between the main nozzles and the dummy nozzles every column serving as a driving cycle of all nozzles for the main nozzles and the dummy nozzles; and a control step of executing and controlling toggle preliminary discharge operation of alternately performing discharge from the main nozzles and the dummy nozzles every column, as preliminary discharge operation of performing preliminary discharge from the main nozzles and the dummy nozzles in the switching step in order to make a good state of a discharge state of the liquid from the main nozzles.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention, and together with the description, serve to explain the principles of the invention.

FIG. 11 is a view showing an example of division of the nozzle array of the printhead according to the embodiment of the present invention;

FIG. 16 is a view showing an example of the connection between the nozzle of the printhead and a driving signal according to the embodiment of the present invention;

FIG. 18 is a view showing an example of preliminary discharge modes according to the embodiment of the present invention;

FIG. 19 is a view showing an example of a circuit description language representing a circuit for implementing toggle preliminary discharge according to the embodiment of the present invention;

FIG. 20 is a view showing a register which sets whether to execute toggle preliminary discharge according to the embodiment of the present invention;

DETAILED DESCRIPTION OF THE PREFERRED EMBODIMENT

A preferred embodiment of the present invention will be described in detail in accordance with the accompanying drawings.

In this specification, "printing" (to be also referred to as "print") is to form an image, design, pattern, or the like on a printing medium by applying a liquid or process a medium regardless of whether to form significant information such as a character or figure, whether information is significant or insignificant, or whether information is so visualized as to allow the user to visually perceive it. "Printing media" are not only paper used in a general printing apparatus, but also ink-receivable materials such as cloth, plastic film, and metal plate. "Ink" should be interpreted as widely as the definition of "printing". "Ink" represents a liquid which is applied to a printing medium to form an image, design, pattern, or the like, or is used to process a printing medium.

Figure 8:
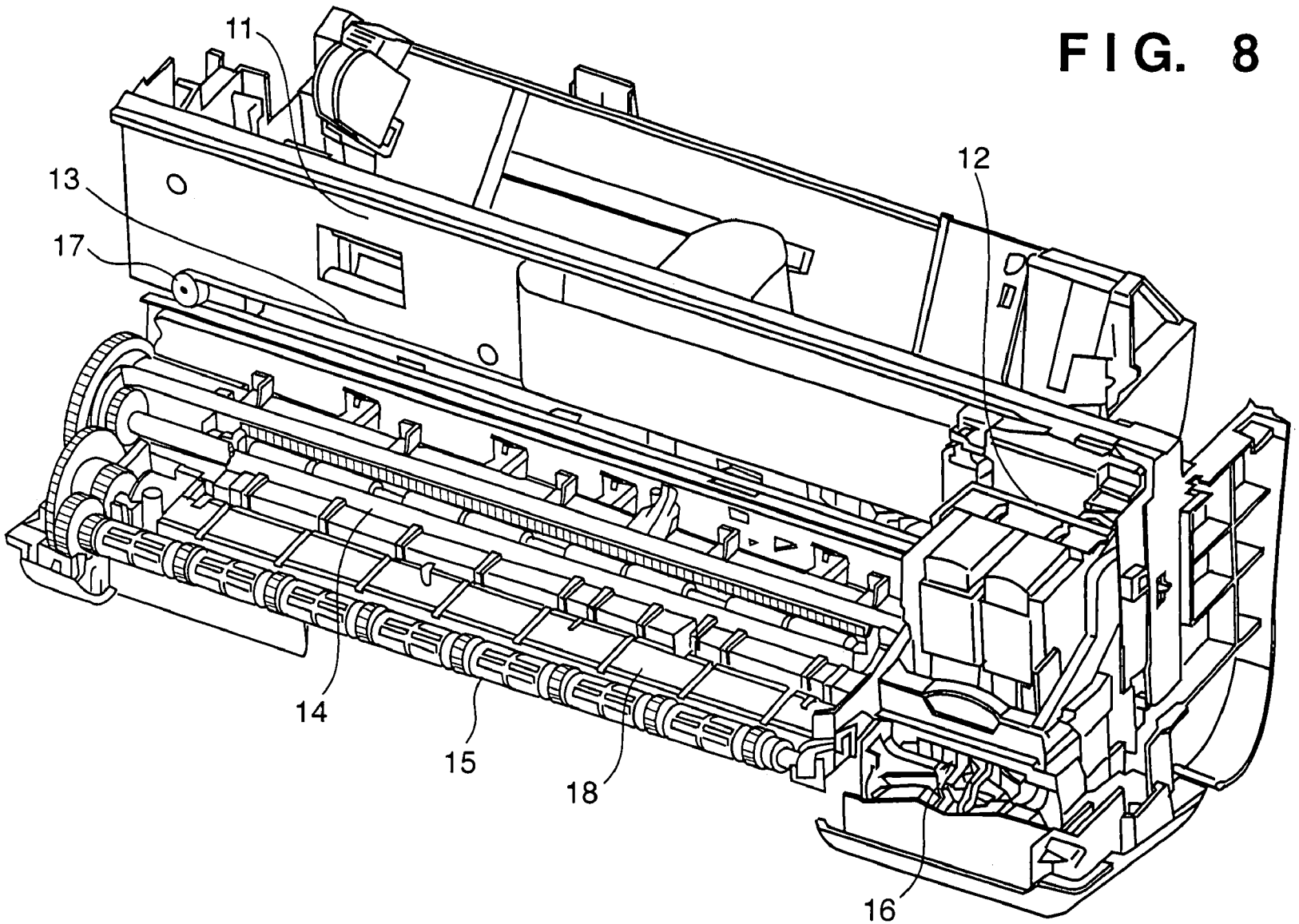
FIG. 8 is a perspective view showing an inkjet printer applicable to the embodiment of the present invention.

FIG. 8 is a perspective view showing an inkjet printer applicable to the embodiment of the present invention.

The functional components of an inkjet printer 11 (to be simply abbreviated as a printer 11 hereinafter) are roughly classified into a carriage 12, timing belt 13, convey roller 14, delivery roller 15, cleaning unit 16, carriage motor 17, and platen 18.

Part of the timing belt 13 which is looped between a pulley attached to the shaft of the carriage motor 17 and a pulley at a symmetrical position is connected to the carriage 12, and the timing belt 13 transmits the driving force of the carriage motor 17. The delivery roller 15 is so set as to rotate at a speed slightly higher than that of the convey roller 14 in order to apply a proper tension to a printing medium on the platen 18.

The structure of the lower surface of the carriage 12 will be described with reference to FIG. 9.

Figure 9:
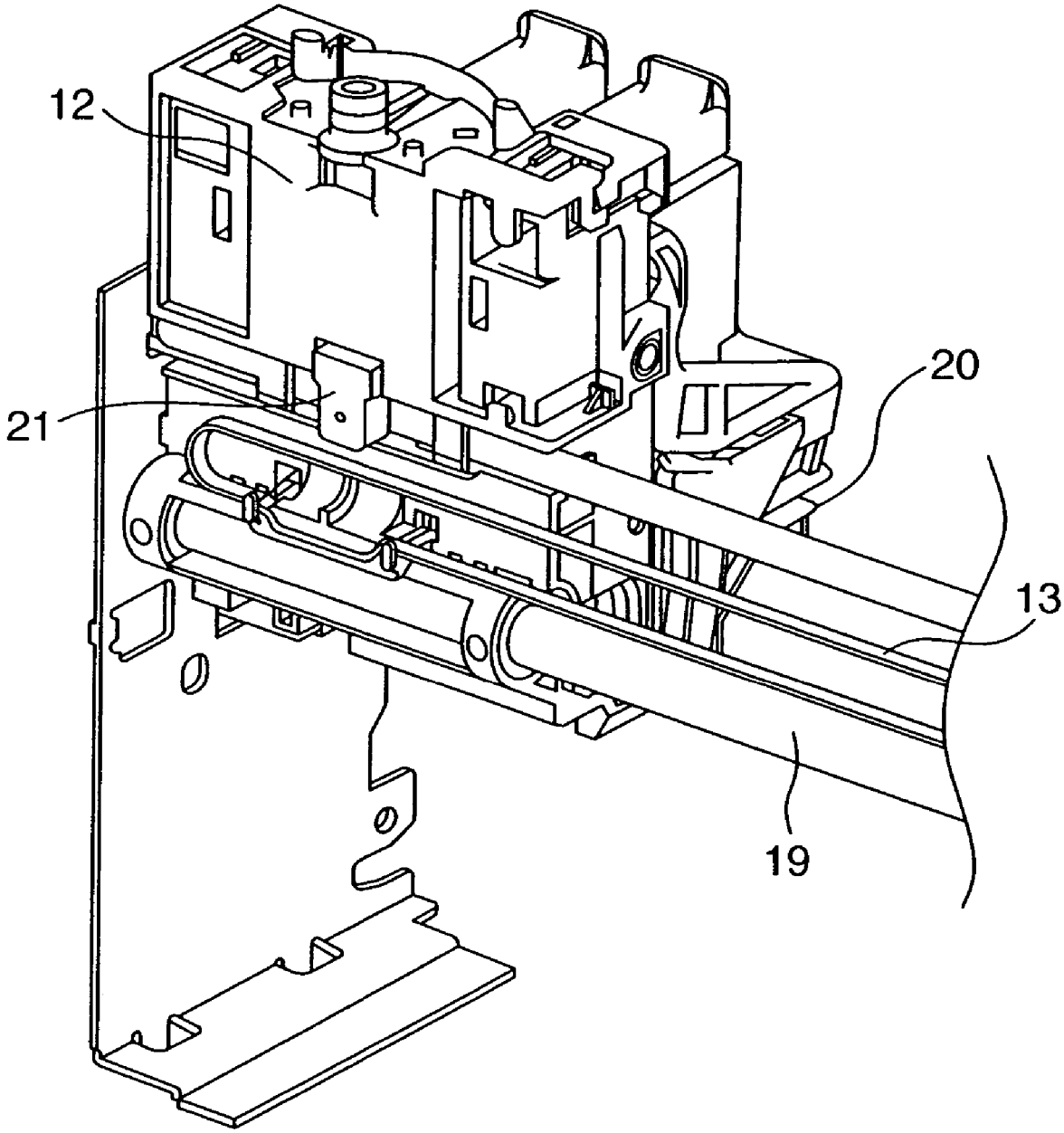
FIG. 9 is a perspective view showing the structure of the lower surface of a carriage according to the embodiment of the present invention.

FIG. 9 is a perspective view showing the structure of the lower surface of the carriage according to the embodiment of the present invention.

The carriage 12 is supported by a shaft 19, and can move right and left. An encoder 21 which reads a scaler 20 is arranged below the lower surface of the carriage 12.

As the carriage 12 moves, the encoder 21 reads the scaler 20 extending along the printer 11. With the encoder 21, the printer 11 sequentially observes the displacement amount of the carriage 12, and feedback-controls the carriage motor 17 on the basis of the information. Timing information for driving a printhead mounted on the carriage 12 is also generated on the basis of positional information of the encoder 21.

A control circuit for controlling various operations of the printer 11 will be explained with reference to FIG. 10.

Figure 10:
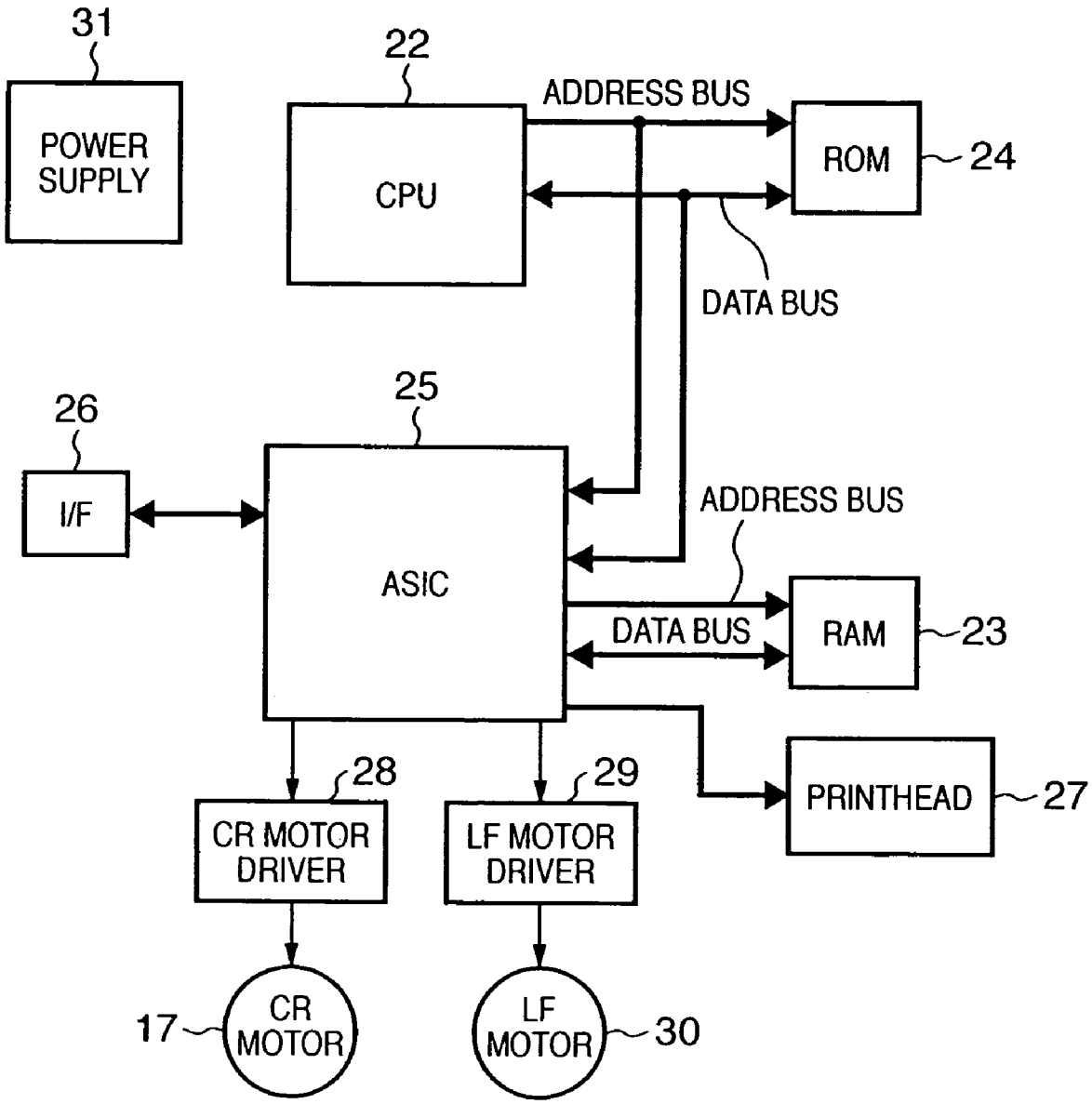
FIG. 10 is a block diagram showing the overall configuration of the control circuit of the printer according to the embodiment of the present invention.

FIG. 10 is a block diagram showing the overall configuration of the control circuit of the printer according to the embodiment of the present invention.

The printer 11 is mainly comprised of a CPU 22, RAM 23, ROM 24, ASIC 25, interface (I/F) 26, printhead 27, and power supply 31.

In FIG. 10, each element is illustrated as a single component, but all elements may be integrated into one LSI package.

The ROM 24 has a program area which stores various programs for controlling the printer 11. The program area stores firmware of the printer 11, a motor driving table, and the like.

The ASIC 25 performs motor driving control, an image process, communication with a host computer via the interface (I/F) 26, ink discharge control of the printhead 27, and the like.

The RAM 23 is used as, e.g., a receive buffer for temporarily storing data received from a host computer, a work area for causing the RAM 23 to function as a temporary memory in performing an image process by the ASIC 25, and a print buffer (scroll print buffer) for storing printing data. A driving data table for driving and controlling a motor is mapped in the work area.

Motor drivers for driving various motors of the printer 11 include two drivers: a CR motor driver 28 for driving the carriage (CR), and an LF motor driver 29 for conveying a printing sheet (LF). The carriage (CR) motor 17 and a sheet convey (LF) motor 30 are driven by corresponding motor drivers.

A combination of the motor drivers and motors in FIG. 10 is merely an example, and the number of motors and that of motor drivers can be arbitrarily set depending on the printer.

The power supply 31 generates, from a commercial power supply, logic power for driving a semiconductor device, power for driving a motor, and power for driving a head. A DC/DC converter used for the power supply 31, the CR motor driver 28, and the LF motor driver 29 may be integrated in a one-chip IC.

Figure 3:
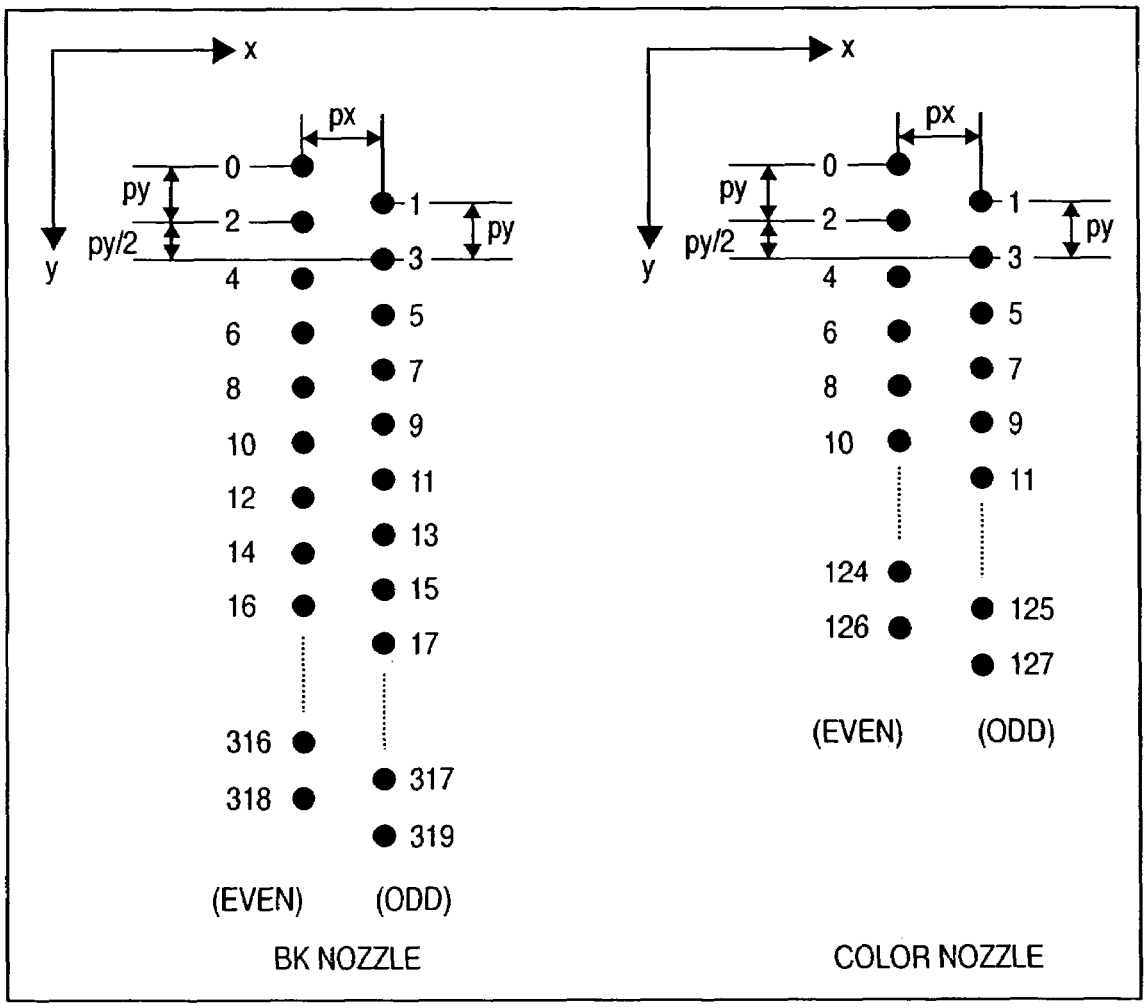
FIG. 3 is a view showing the layout of the nozzle array of the inkjet printhead.
Figure 4:
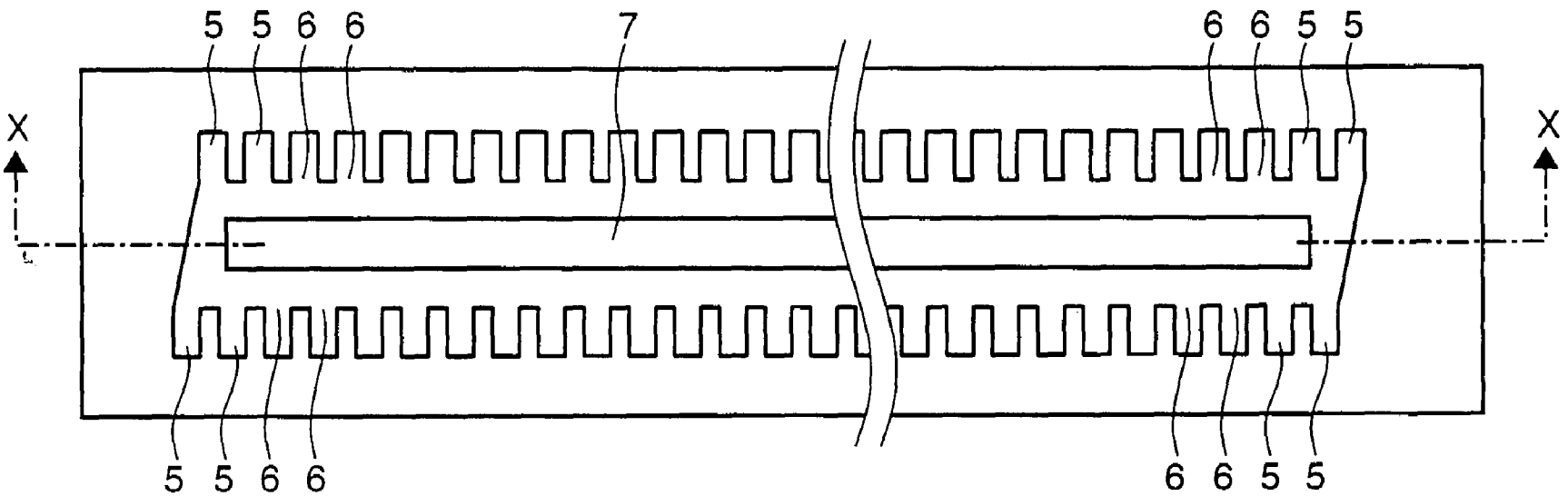
FIG. 4 is a view showing the schematic structure of the nozzle array of the inkjet printhead.
Figure 5:
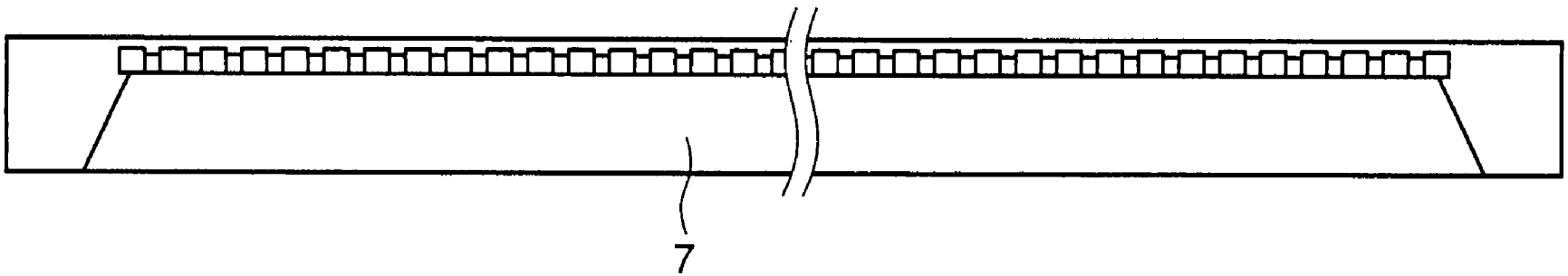
FIG. 5 is a sectional view showing the sectional structure of the nozzle array in FIG. 4 taken along the X direction.
Figure 6:
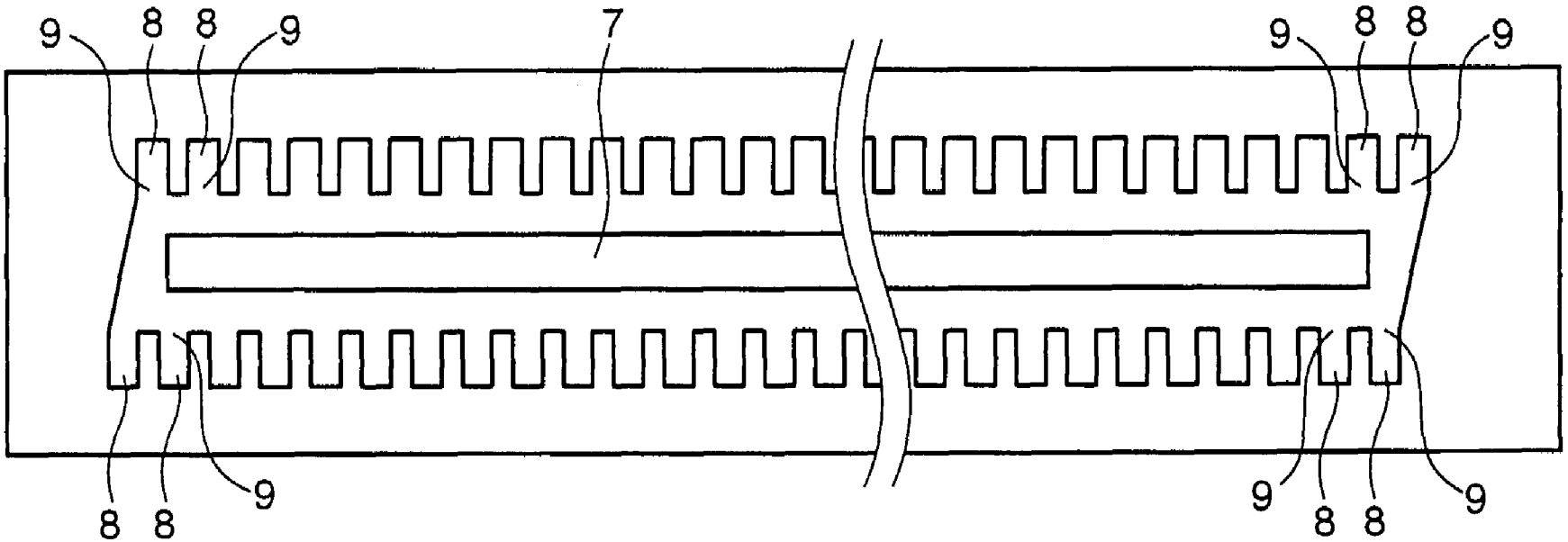
FIG. 6 is a view showing the schematic structure of the nozzle array of the inkjet printhead.
Figure 7B:
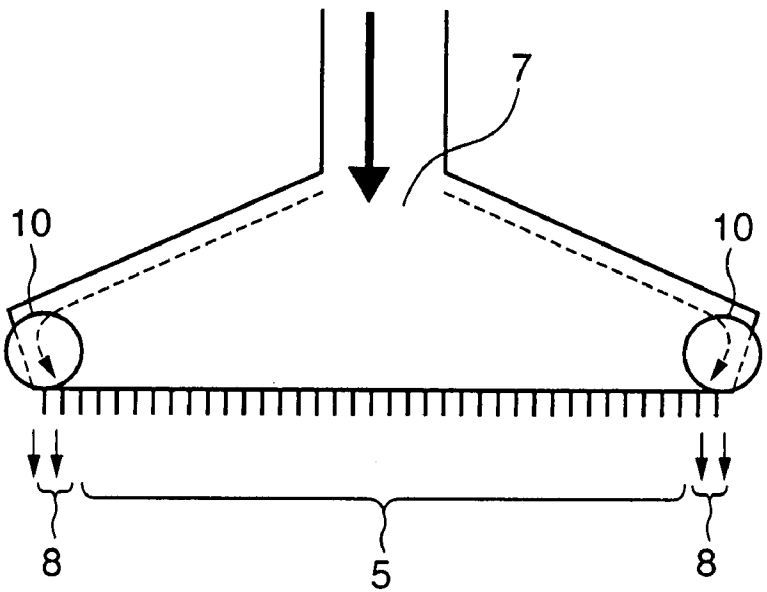
FIG. 7B is a view schematically showing the state of preliminary discharge.
Figure 7A:
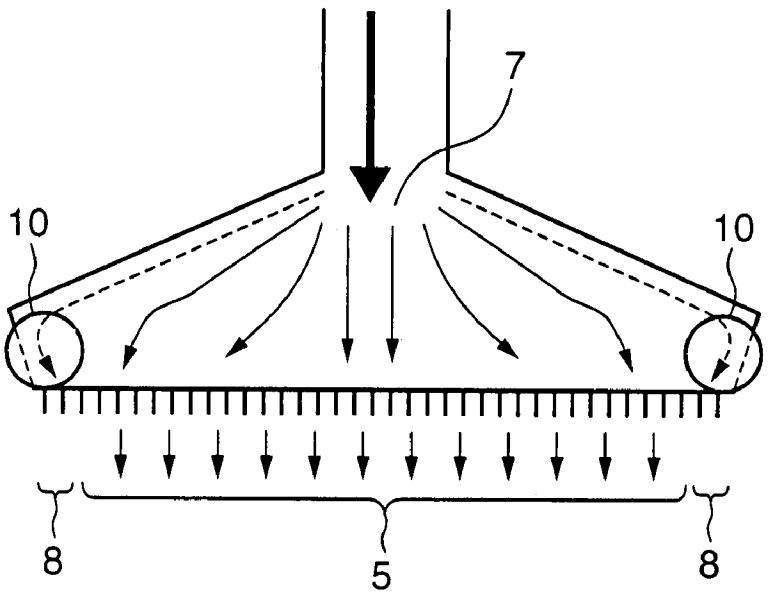
FIG. 7A is a view schematically showing the state of preliminary discharge.

Driving of the printhead 27 generally adopts a method of dividing a plurality of nozzles aligning in a line in the column direction (y direction) in FIG. 3 into several nozzle groups, and driving the nozzle groups at different timings (time division driving). Details of this method are described in, e.g., Japanese Patent Laid-Open No. 2000-071433. Time division driving of nozzles can increase the ink supply speed and stability, and reduce power consumption necessary for discharge.

The host computer generates printing data which enables printing control by a control circuit, and controls output of the printing data to the printer 11. Generation and output control of printing data are implemented by a dedicated program such as a printer driver which is installed in the host compute and corresponds to the printer 11. A process executed by the dedicated program may be implemented by dedicated hardware.

The host computer has standard building components (e.g., a CPU, RAM, ROM, hard disk, external storage, network interface, display, keyboard, and mouse) which are mounted in a general-purpose computer such as a personal computer (including various types such as notebook type and desktop type).

The host computer may be a portable terminal such as a digital camera, cell phone, or PDA, in addition to the personal computer.

An example of division of a nozzle array when the printhead 27 is driven by time division will be explained with reference to FIG. 11.

FIG. 11 is a view showing an example of division of the nozzle array of the printhead according to the embodiment of the present invention.

In FIG. 11, nozzle arrays each divided into 16 blocks are exemplified, and the nozzle layouts of the respective blocks are represented by tables for a black nozzle array and color nozzle array. As the block layout, as shown in FIG. 11, nozzles at an interval of 32 nozzles form the same block. Giving attention to only the EVEN side, nozzles at an interval of 16 nozzles belong to the same block. By classifying nozzles at a predetermined interval into the same block, a layout hardly influenced by driving of adjacent nozzles can be implemented.

A printhead control block for driving the printhead 27 will be described. The printhead control block is one block which forms the ASIC 25, and will be explained with reference to FIG. 12.

Figure 12:
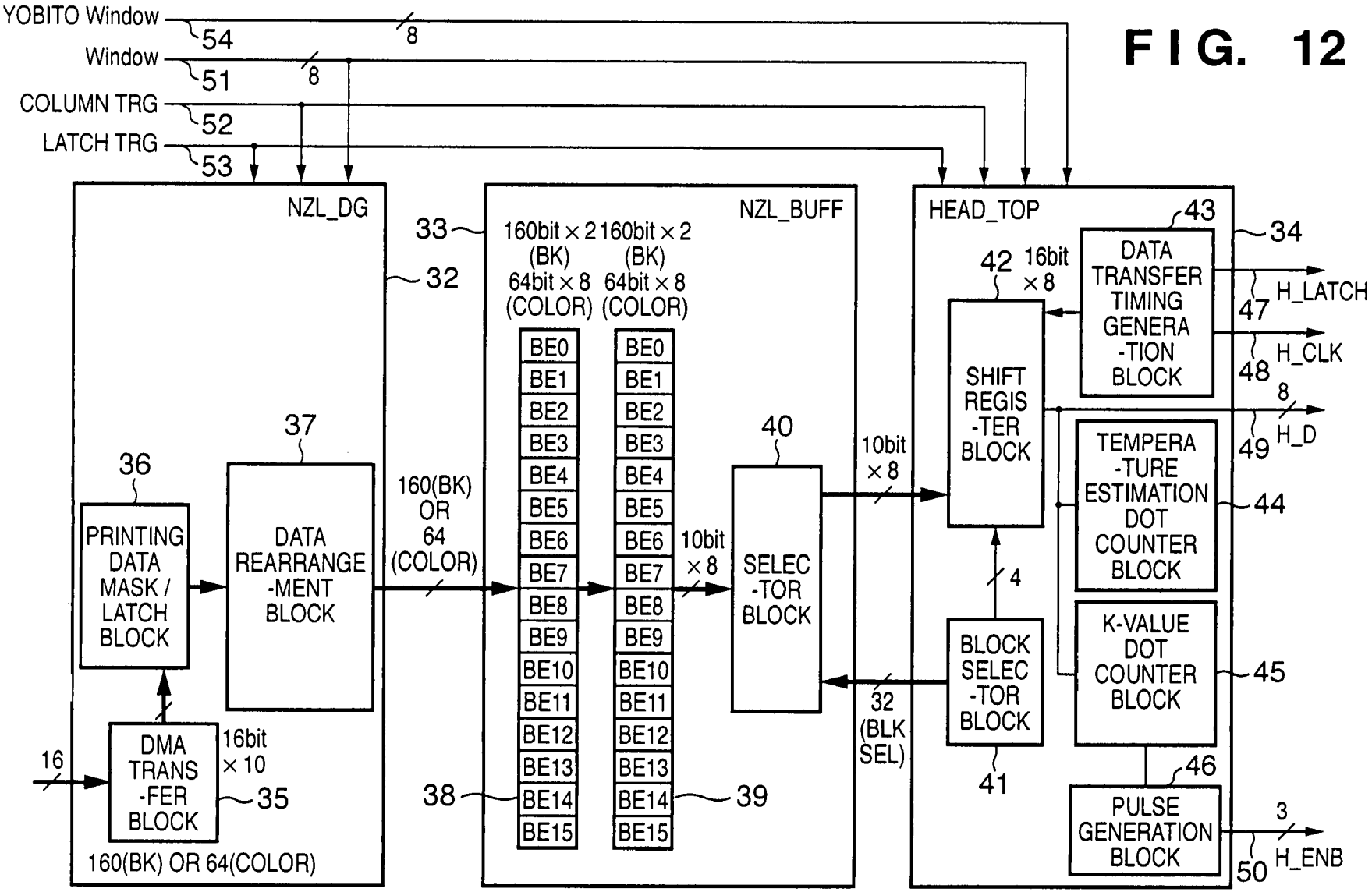
FIG. 12 is a block diagram showing a printhead control block according to the embodiment of the present invention.

FIG. 12 is a block diagram showing the printhead control block according to the embodiment of the present invention.

As is apparent from FIG. 12, the printhead control block is formed from three blocks, i.e., a nozzle data generation block (NZL_DG) 32, nozzle data holding block (NZL_BUFF) 33, and printhead control block (HEAD_TOP) 34.

Reference timing signals for driving the printhead control block are Window 51, Column TRG 52, and Latch TRG 53 output from a block which generates a printing timing from an encoder signal (not shown).

Window 51 is a signal whose flag is set (Window Open) when the carriage 12 moves in the raster direction (main scanning direction) and reaches a printing-designated portion, and is cleared (Window Close) when printing ends. A total of eight Window signals 51 exist because they are set for the EVEN and ODD nozzle arrays of black and the three colors.

Column TRG 52 is a trigger signal output at a column interval, and the interval of the column trigger corresponds to the printing resolution in the raster direction.

Latch TRG 53 is a signal generated at a timing prepared by uniformly dividing the column interval by the number of blocks. When the nozzle array is formed from 16 blocks, like the embodiment, 16 Latch TRG signals are generated within one column time.

YOBITO Window 54 (representing Preliminary Discharge Window) is a Window signal for color setting in preliminary discharge. A total of eight YOBITO Window signals 54 exist because they are set for the EVEN and ODD nozzle arrays of black and the three colors. YOBITO Window 54 is not synchronized with an encoder signal along with movement of the carriage 12, and is a flag signal for performing preliminary discharge when Window of a nozzle array set in preliminary discharge is opened.

The nozzle data generation block (NZL_DG) 32 is comprised of a DMA (Direct Memory Access) transfer block 35, printing data mask/latch block 36, and data rearrangement block 37.

The DMA transfer block 35 receives printing data mapped in the RAM 23 by DMA transfer. Data received when all nozzles are used for printing is 16 (bits)×10 (DMA count)=160 (bits) for the EVEN or ODD nozzle array of black, and 16 (bits)×4 (DMA count)=64 (bits) for the EVEN or ODD nozzle array of one color. In this manner, the DMA count is determined in accordance with the number of nozzles for use.

The printing data mask/latch block 36 has a function of latching printing data acquired by DMA transfer, and masking (nozzle mask) unused nozzles on the basis of register information (not shown). Nozzle mask can be set for each nozzle.

The data rearrangement block 37 rearranges printing data on the basis of the block of printing nozzles. That is, the data rearrangement block 37 rearranges printing data into the nozzle data array of each block on the basis of information on nozzles which form a block, as shown in FIG. 11.

A main signal for activating the nozzle data generation block (NZL_DG) 32 is a combination of Window 51 and Column TRG 52. When printing data reaches a printing-designated portion by Window 51 and the nozzle data generation block (NZL_DG) 32 receives Column TRG 52, the nozzle data generation block (NZL_DG) 32 starts acquiring printing data. When Window 51 is closed, the nozzle data generation block (NZL_DG) 32 stops acquiring printing data.

The nozzle data holding block (NZL_BUFF) 33 is a buffer for holding nozzle data having the layout of each block shown in FIG. 11.

The reason that the data array and the nozzle array which forms each block of the printhead 27 coincide with each other is to facilitate data management and hence generation of printing driving data by the printhead 27.

The buffer formed by the nozzle data holding block includes two buffers, i.e., a first buffer 38 and second buffer 39. Each buffer holds data of one column for all colors, i.e., all block data of one column.

The buffer has a structure of 160 bits×2 corresponding to the EVEN and ODD nozzle arrays for black, and a structure of 64 bits×6 corresponding to the EVEN and ODD nozzle arrays for the three colors.

Data within the buffer takes a block layout as shown in FIG. 11, and is 10 (bits)×16 (blocks)=160 (bits) for black and 4 (bits)×16 (blocks)=64 (bits) for each color.

The buffer includes two buffers in order to prepare for data of the next column while transferring block data in one column to the printhead 27. The first buffer 38 serves as a write side, whereas the second buffer 39 serves as a read side.

A selector block 40 sequentially selects blocks and outputs nozzle data for each block on the basis of a block selection signal from a block selector block 41 of the printhead control block (HEAD_TOP) 34.

The bus width of nozzle data is 10 (bits)×8 (colors). As shown in FIG. 11, nozzle data are assigned to all 10 bits for black data (BK_DATA). However, for color data (COLOR_DATA), nozzle data are assigned to only 4 bits, and thus data "0" are set at upper 6 bits. The reason that the bus widths of nozzle data are set equal is to utilize the circuit of the printhead control block (HEAD_TOP) 34 commonly between the respective colors.

The printhead control block (HEAD_TOP) 34 comprises the block selector block 41, a shift register block 42, a data transfer timing generation block 43, a temperature estimation dot counter block 44, a K-value dot counter block 45, and a pulse generation block 46.

The printhead control block (HEAD_TOP) 34 outputs printhead driving signals H_LATCH 47, H_CLK 48, H_D 49, and H_ENB 50.

The printhead control block (HEAD_TOP) 34 is activated mainly by Window 51 and Latch TRG 53. When preliminary discharge is performed for the printhead 27, a nozzle array is selected by YOBITO Window 54. Latch TRG 53 and Column TRG 52 are enabled only when the carriage 12 reaches a printing-designated portion and Window 51 is opened or when the preliminary discharge sequence is activated and YOBITO Window 54 is opened.

The block selector block 41 outputs a block selection signal to the selector block 40 of the nozzle data holding block (NZL_BUFF) 33 in accordance with the block order in response to the trigger signal Latch TRG 53 to time division driving of the printhead 27. At the same time, the block selector block 41 also outputs a block selection signal to the shift register block 42.

The shift register block 42 converts the block selection signal and nozzle data output from the nozzle data holding block (NZL_BUFF) 33 into serial data by a shift register, and outputs the serial data as the printhead driving data H_D 49. The printhead driving data H_D 49 is formed from eight data because each of black and the three colors has EVEN and ODD nozzle arrays.

By using Latch TRG 53 as a reference signal, the data transfer timing generation block 43 generates the transfer clock H_CLK 48 for transferring the printhead driving data H_D 49 to the printhead 27, and the latch signal H_LATCH 47 for latching data in the internal shift register of the printhead 27. The data transfer timing generation block 43 outputs a data shift timing signal to the shift register block 42.

The temperature estimation dot counter block 44 and K-value dot counter block 45 are arithmetic blocks for correcting, in accordance with the nozzle discharge frequency, the driving pulse width of the heat enable signal H_ENB 50 generated by the pulse generation block 46.

The temperature estimation dot counter block 44 is used to change a correction table at an interval of several ten ms. The K-value dot counter block 45 corrects, by using Latch TRG 53 as a reference signal, the optimal heat pulse width of the next block on the basis of the temperature rise state of each block depending on the nozzle discharge frequency of the preceding block (this correction control will be referred to as K-value control).

The heat enable signal H_ENB 50 is formed from one black signal and two color signals. The reason that the two color signals are used is to distribute energy necessary for discharge by shifting the heat timing.

The driving timing of the printhead 27 will be explained with reference to FIG. 13.

Figure 13:
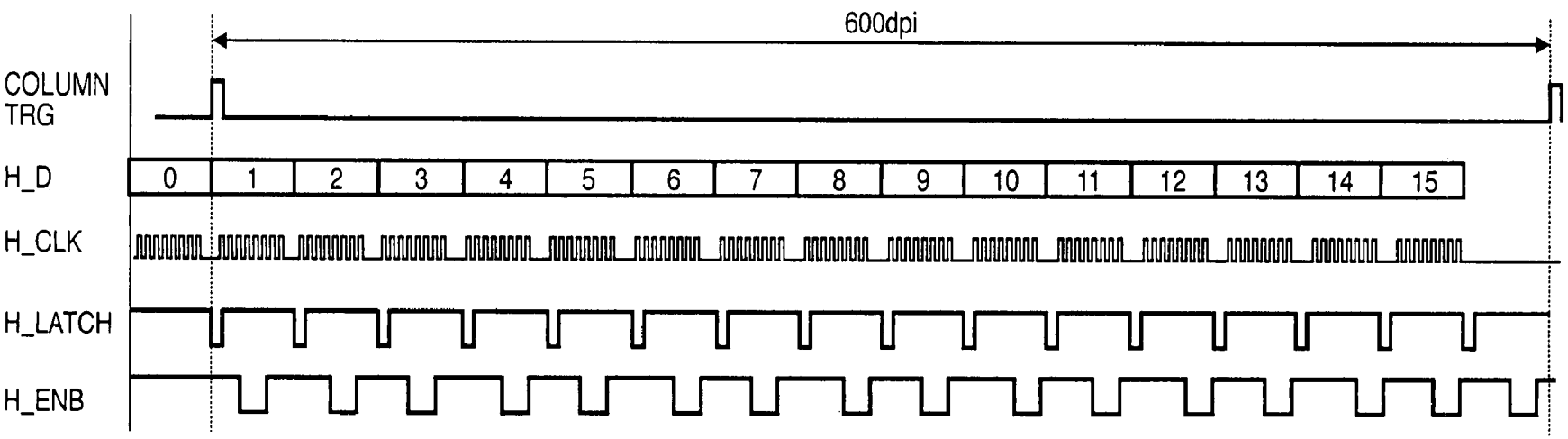
FIG. 13 is a timing chart showing the driving timing of the printhead according to the embodiment of the present invention.

FIG. 13 is a timing chart showing the driving timing of the printhead according to the embodiment of the present invention.

FIG. 13 shows the driving timing of the printhead per column in printing at a resolution of 600 dpi.

In FIG. 13, Column TRG 52 is an internal signal, and H_LATCH 47, H_CLK 48, H_D 49, and H_ENB 50 are printhead driving signals. As shown in FIG. 13, one column is formed from 16 blocks, and driven by time division.

The printhead driving data H_D 49 is transferred to the internal shift register of the printhead 27 in response to the transfer clock H_CLK 48, and latched in response to the trailing edge of H_LATCH 47. The latched printhead driving data is output to the next block in response to the heat pulse of the heat enable signal H_ENB 50, and the next driving data transfer is performed.

The relationship between the transfer clock H_CLK 48 and the printhead driving data H_D 49 will be described with reference to FIG. 14.

Figure 14:
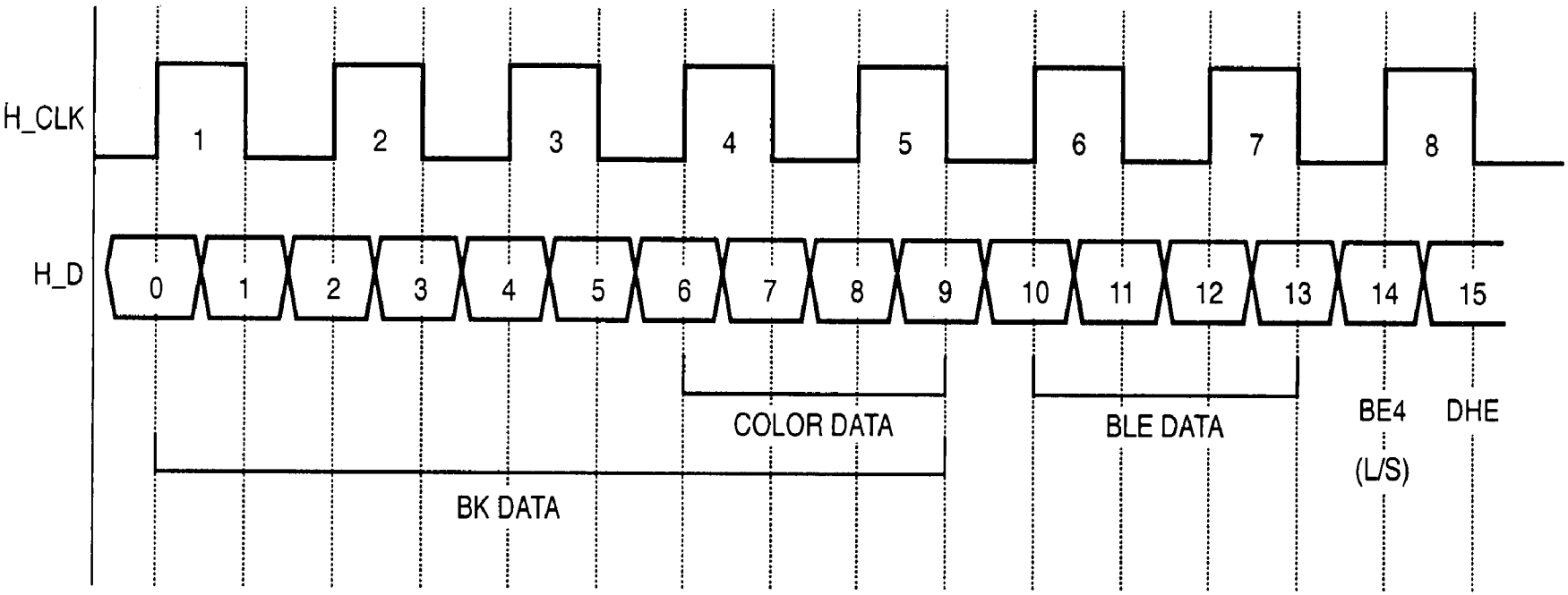
FIG. 14 is a timing chart showing the relationship between a transfer clock and printhead driving data according to the embodiment of the present invention.

FIG. 14 is a timing chart showing the relationship between the transfer clock and the printhead driving data according to the embodiment of the present invention.

The printhead driving data H_D 49 can be acquired at the two edges of the transfer clock H_CLK 48 in order to shorten the transfer time. The frequency of the transfer clock H_CLK 48 is about 6 MHz.

The data structure of the printhead driving data H_D 49 includes bit 0 to 9 as nozzle data, of which 10 bits are used for black and 4 bits of bit 6 to 9 are used for color. Four bits of bit 10 to 13 form block selection data BLE, and a driving block is selected within the printhead 27 on the basis of the 4-bit block selection data BLE.

bit 14 is heater switching data BE4 (L/S), and selects a large heater (A heater) or small heater (B heater) (to be described later) for the color main nozzle 5.

The large heater discharges ink of about 5 pl from a nozzle, and the small heater discharges ink of about 2 pl from a nozzle. Bit 15 is dummy nozzle selection data DHE for selecting the dummy nozzle 8. A dummy nozzle which performs discharge is selected by a combination of the dummy nozzle selection data DHE and block selection data BLE.

When preliminary discharge is executed for the printhead 27, data for a nozzle subjected to preliminary discharge is set in the first buffer 38 of the nozzle data holding block (NZL_BUFF) 33, and latched in the second buffer 39.

A nozzle array which is to perform preliminary discharge is set in the setting register of YOBITO Window 54. Column TRG 52 and Latch TRG 53 are generated at arbitrary timings without using the timing of an encoder signal, and input to the printhead control block (HEAD_TOP) 34. This method implements preliminary discharge operation.

The structure of a printhead optimal for the present invention will be explained with reference to FIG. 15.

Figure 15:
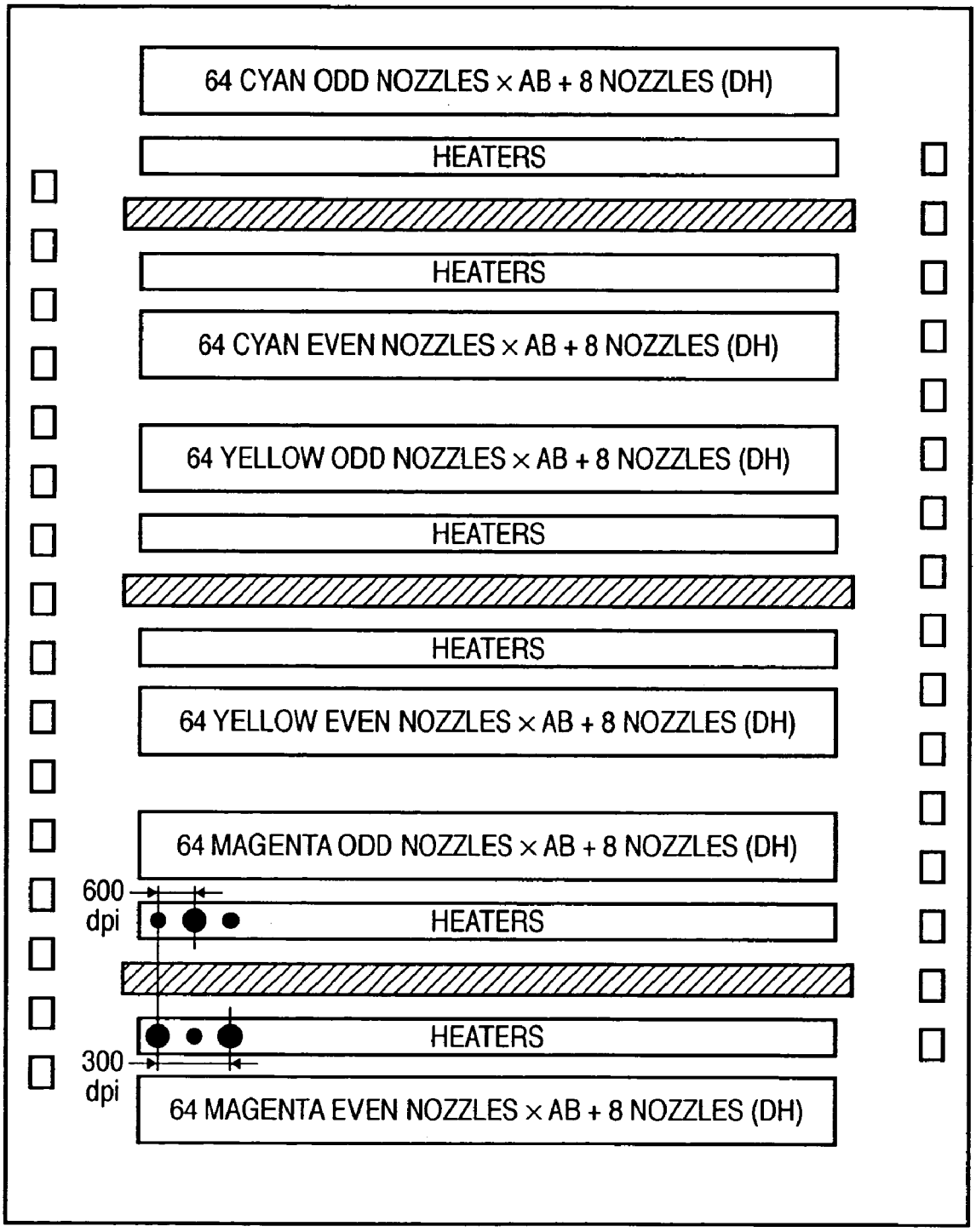
FIG. 15 is a view showing the chip layout of the printhead according to the embodiment of the present invention.

FIG. 15 is a view showing the chip layout of the printhead according to the embodiment of the present invention.

As shown in FIG. 15, the printhead of the embodiment is made up of six nozzle arrays, and each nozzle array is formed from 64 main nozzles×2 (A nozzles and B nozzles) and eight dummy nozzles.

The A nozzle is a nozzle having a heater for discharging a 5-pl ink droplet. The B nozzle is a nozzle for discharging a 2-pl ink droplet. A heater for the A nozzle will be called an A heater, and a heater for the B nozzle will be called a B heater.

As shown in FIG. 15, the A and B nozzles are alternately positioned, the nozzle pitch between A nozzles is 300 dpi, and the nozzle pitch between A and B nozzles is 600 dpi. The A and B nozzles are staggered. The A and B nozzles cannot be simultaneously driven because the heat enable signal H_ENB 50 is used commonly for the A and B nozzles.

Thus, either the A nozzles or B nozzles are alternately switched every Column TRG 52. This selection is based on the printing medium characteristic and image quality setting. For example, in normal printing in which printing is done on a plain paper sheet, the A nozzles are used to reduce printing scanning and perform printing at a high speed. For the photographic quality, high quality is implemented by multipass printing using a high-quality dedicated paper sheet and the B nozzles.

The connection between the nozzle of the printhead and a driving signal will be described with reference to FIGS. 16 and 17.

FIG. 16 is a view showing an example of the connection between the nozzle of the printhead and the driving signal according to the embodiment of the present invention. FIG. 17 is a view showing the structure of the nozzle surface of the printhead shown in FIG. 15 according to the embodiment of the present invention.

The block selection data BLE is divided into 16 blocks 0 to 15. The A and B heaters are switched by the switching data BE4 (L/S) of bit 14 in FIG. 15. A dummy nozzle is selected by the dummy nozzle selection signal DHE of bit 15 and a BLE number (block selection number) assigned to each dummy nozzle.

In the example of FIG. 16, dummy nozzles (DH0A to DH7A and DH0B to DH7B) perform discharge when BLE numbers 0, 1, 14, and 15 are selected. For a discharge heat signal, H_ENB1 or H_ENB2 corresponding to the segment of a connected dummy heater is selected.

Figure 17:
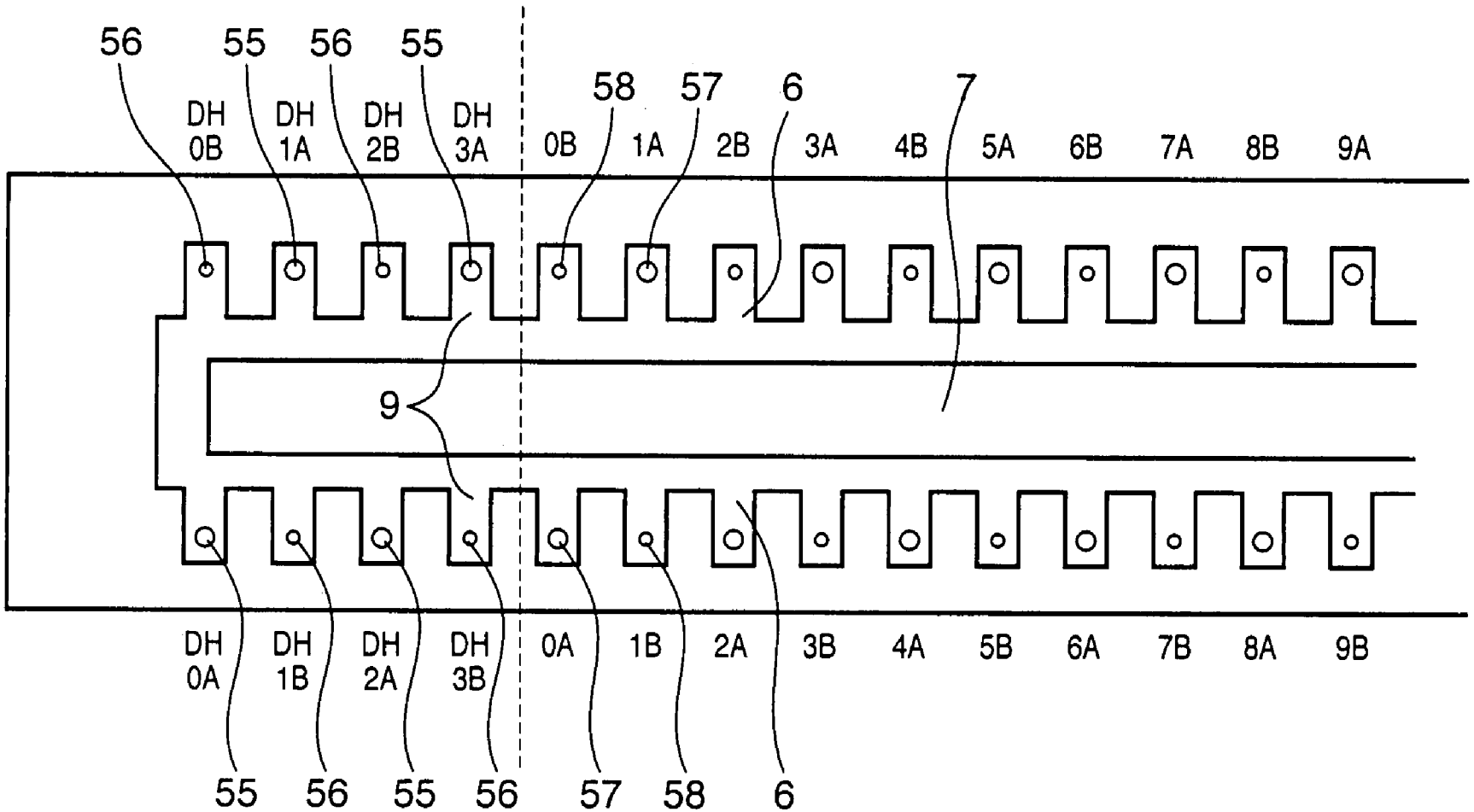
FIG. 17 is a view showing the structure of the nozzle surface of the printhead shown in FIG. 15 according to the embodiment of the present invention.

In FIG. 17, reference numerals 55 denote dummy nozzles (DH0A to DH3A) having A heaters; 56, dummy nozzles (DH0B to DH3B) having B heaters; 57, main nozzles (from 0A) having A heaters; and 58, main nozzles (from 0B) having B heaters. Reference numerals 6 denote ink chambers for main nozzles; 7, a common ink chamber; and 9, ink chambers for dummy nozzles.

The pitches between the dummy nozzles 55 and 56 and that between the main nozzles 57 and 58 are set equal to each other in FIG. 17, but the pitch between the dummy nozzles 55 and 56 may be set larger. Alternatively, the nozzle ports and heaters of the dummy nozzles 55 and 56 may be changed from those of the main nozzles so as to control the discharge amount. The structure of the dummy nozzle is so designed as to obtain an optimal number of nozzles, an optimal interval, and an optimal discharge amount in accordance with the characteristics of the printhead 27.

As described above, the printhead comprises the common liquid chamber (ink chamber) 7 which receives a liquid, a plurality of main nozzles (e.g., 58 and 57) which align at a predetermined interval on the two sides of the common liquid chamber 7 along the longitudinal direction of the common liquid chamber 7 and used for printing, a plurality of dummy nozzles (e.g., 55 and 56) which align on the two sides of the main nozzles along their array direction and are not used for printing, and a plurality of liquid chambers (e.g., the ink chambers 6 and 9) which communicate with the common liquid chamber 7 while the main and dummy nozzles are open in the liquid chambers.

The preliminary discharge sequence includes various preliminary discharge sequences in accordance with the application. An example of representative preliminary discharge modes will be explained with reference to FIG. 18.

FIG. 18 is a view showing an example of the preliminary discharge modes according to the embodiment of the present invention.

Preliminary discharge in each of these preliminary discharge modes is basically performed for all nozzles including dummy nozzles, and actually executed double the preliminary discharge count in FIG. 18.

Preliminary discharge J and preliminary discharge K are done after suction/recovery by cleaning operation. Preliminary discharge I is done after wiping operation. These preliminary discharge operations are performed to discharge mixed ink by recovery/suction. Preliminary discharge L performed during printing prevents thickening of ink in a nozzle, and keeps the nozzle available.

A characteristic printhead driving method for preliminary discharge according to the present invention will be explained with reference to FIG. 1.

Figure 1:
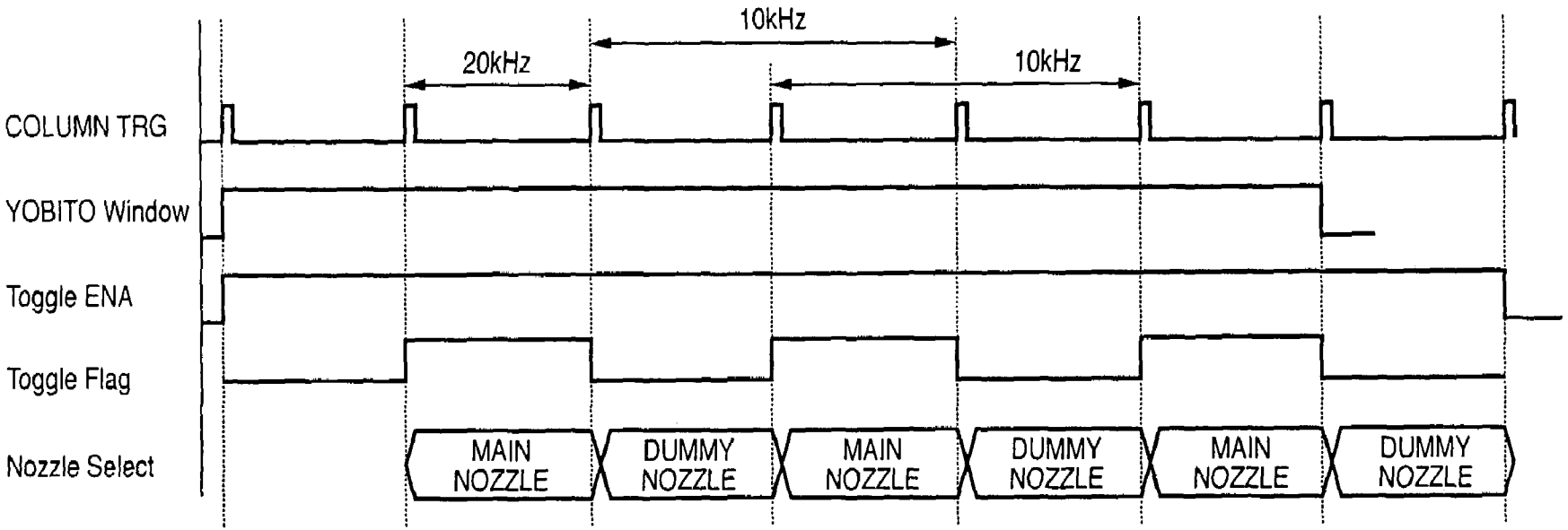
FIG. 1 is a timing chart in a characteristic printhead driving method according to an embodiment of the present invention.
Figure 2:
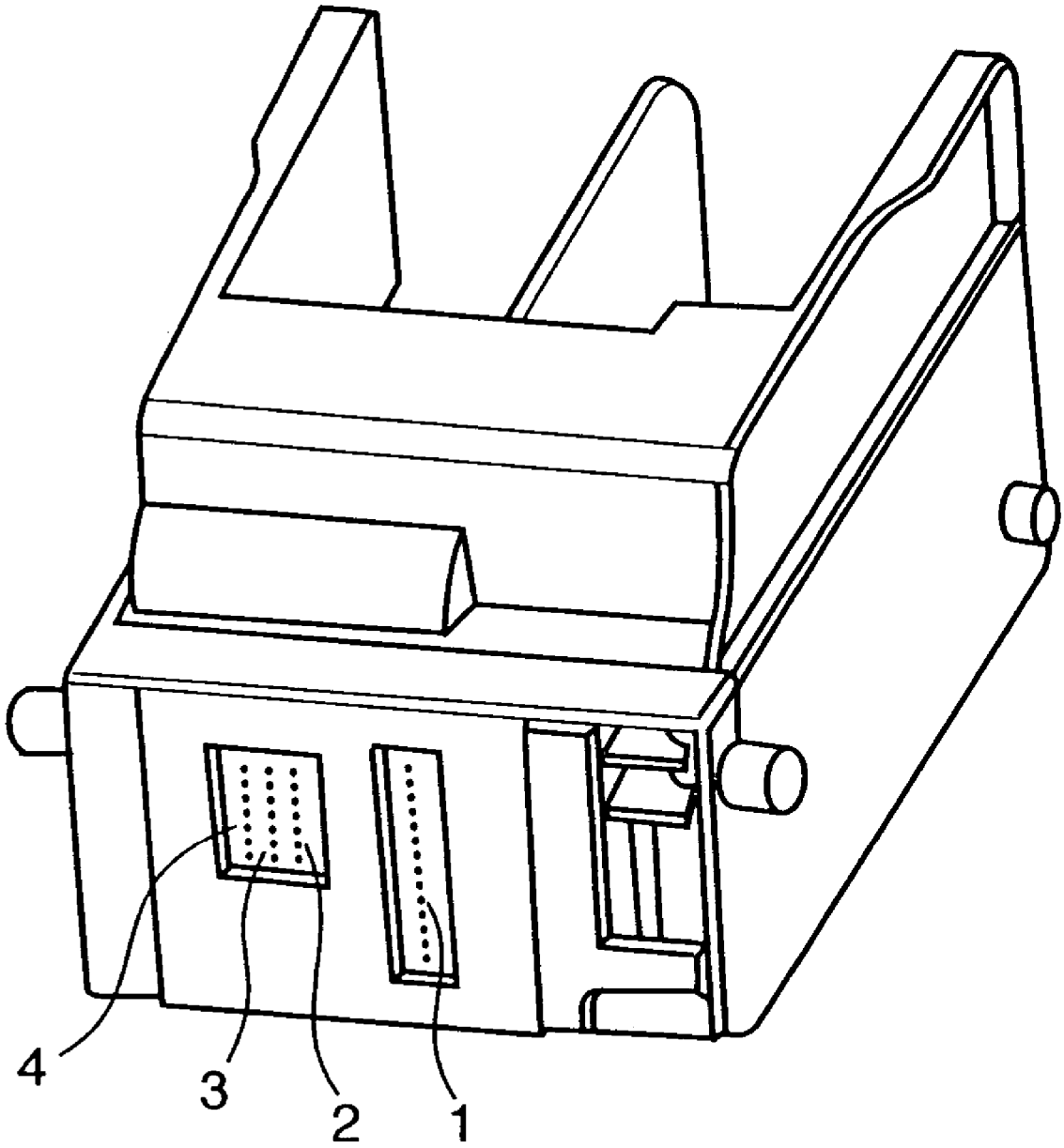
FIG. 2 is a perspective view showing the outer appearance of a general inkjet printhead.

FIG. 1 is a timing chart in the characteristic printhead driving method according to the embodiment of the present invention.

In FIG. 1, a Toggle ENA signal is an enable signal representing whether to toggle (alternate) preliminary discharge by main and dummy nozzles, and is set by a register (FIG. 20: to be described later). When the Toggle ENA signal is enabled ("High"), a Toggle Flag signal is repetitively inverted every Column TRG 52. Nozzle selection of the printhead 27 is based on the Toggle Flag signal.

When the Toggle Flag signal is "High", data for driving main nozzles is generated; when "Low", data for driving dummy nozzles is generated. Preliminary discharge in which main and dummy nozzles alternately perform discharge will be referred to as toggle preliminary discharge in the present invention.

This printhead driving method can double the discharge frequency of preliminary discharge in comparison with a conventional method.

In the example of FIG. 1, the interval of Column TRG 52 can be set to 20 kHz. Even if the discharge frequency of preliminary discharge is doubled, preliminary discharge by main nozzles and preliminary discharge by dummy nozzles are executed every column, and the discharge frequency of each nozzle is halved and coincides with the conventional discharge frequency. Hence, the total preliminary discharge time (driving cycle of all nozzles) can be halved from the conventional time.

A circuit description language representing a circuit for implementing toggle preliminary discharge will be described with reference to FIG. 19.

FIG. 19 is a view showing an example of the circuit description language representing a circuit for implementing toggle preliminary discharge according to the embodiment of the present invention.

In FIG. 19, attention is given to a color nozzle array, and the circuit description language is VHDL.

In FIG. 19, signals L_3_NZL_BUF_DT_C1, L_3_NZL_BUF_DT_M1, L_3_NZL_BUF_DT_Y1, L_3_NZL_BUF_DT_Y2, L_3_NZL_BUF_DT_M2, and L_3_NZL_BUF_DT_C2 correspond to printing data of bit 6 to bit 9 in the printhead transfer data of FIG. 14. An L_DUMMY_HEAT(1) signal corresponds to DHE of bit 15.

A description block 59 represents execution contents (ENABLE) when toggle preliminary discharge is performed by main and dummy nozzles.

A description block 64 represents execution contents (DISABLE) when no toggle preliminary discharge is performed. Conditions for performing no toggle preliminary discharge are normal printing and preliminary discharge by a conventional method, and data only passes through the block. The execution contents of conditions for performing toggle preliminary discharge are functions added on the basis of the present invention.

A condition (ENABLE/DISABLE) of whether to execute toggle preliminary discharge is set by an ENB_YOBI_COLOR_TGL signal in a description 62. This signal corresponds to the Toggle ENA signal in FIG. 1, is supplied from a register for setting whether to execute toggle preliminary discharge, and is enabled for "1" and disabled for "0".

A description block 60 represents execution contents when preliminary discharge is performed by main nozzles. A description block 61 represents execution contents when preliminary discharge is performed by dummy nozzles. The discharge nozzle switching condition is set by a DTRANS_YOBI_COLOR_TGL_FLG signal in a description 63. This signal corresponds to the Toggle Flag signal in FIG. 1, and is repetitively inverted every Column TRG 52. In response to this, the execution contents of the description block 60 for main nozzles and those of the description block 61 for dummy nozzles are alternately selected to implement toggle preliminary discharge.

When preliminary discharge is performed by main nozzles on the condition that the DTRANS_YOBI_COLOR_TGL_FLG signal is "1", printing data passes through the block, but the dummy heater selection L_DUMMY_HEAT(1) signal is "0", and main nozzles are selected.

When the dummy nozzles 61 are selected, no printing data is needed, unlike the above case. Thus, data "0" ("0000") are set in printing data. The reason that data "0" is set is to prevent the temperature detection dot counter 44 and K-value dot counter 45 shown in FIG. 12 from counting data in driving dummy nozzles.

The color nozzle array of the printhead according to the embodiment has a total of eight dummy nozzles, but the A and B heaters cannot be simultaneously driven, and the number of simultaneously dischargeable nozzles is as half as four. Since four nozzles among 64 nozzles of one column perform preliminary discharge, a discharged ink droplet amount and heat pulse correction (K-value control) upon the temperature rise of the printhead can be substantially ignored.

When dummy nozzles are selected, the L_DUMMY_HEAT(1) signal is set to "1". A description block 65 generates bit 15 to bit 0 of printhead transfer data in FIG. 14. The description block 65 couples nozzle data, the block selection data BLE, switching data (A/B heater selection data BE4 (L/)), and the dummy nozzle selection data DHE.

The register which sets whether to execute toggle preliminary discharge will be explained with reference to FIG. 20.

FIG. 20 is a view showing the register which sets whether to execute toggle preliminary discharge according to the embodiment of the present invention.

As shown in FIG. 20, the register (register name DTRNS_LD (41)) sets whether to execute toggle preliminary discharge by black nozzles at bit 0 and color nozzles at bit 1. The register value corresponds to ENB_YOBI_COLOR_TGL.

Figure 21:
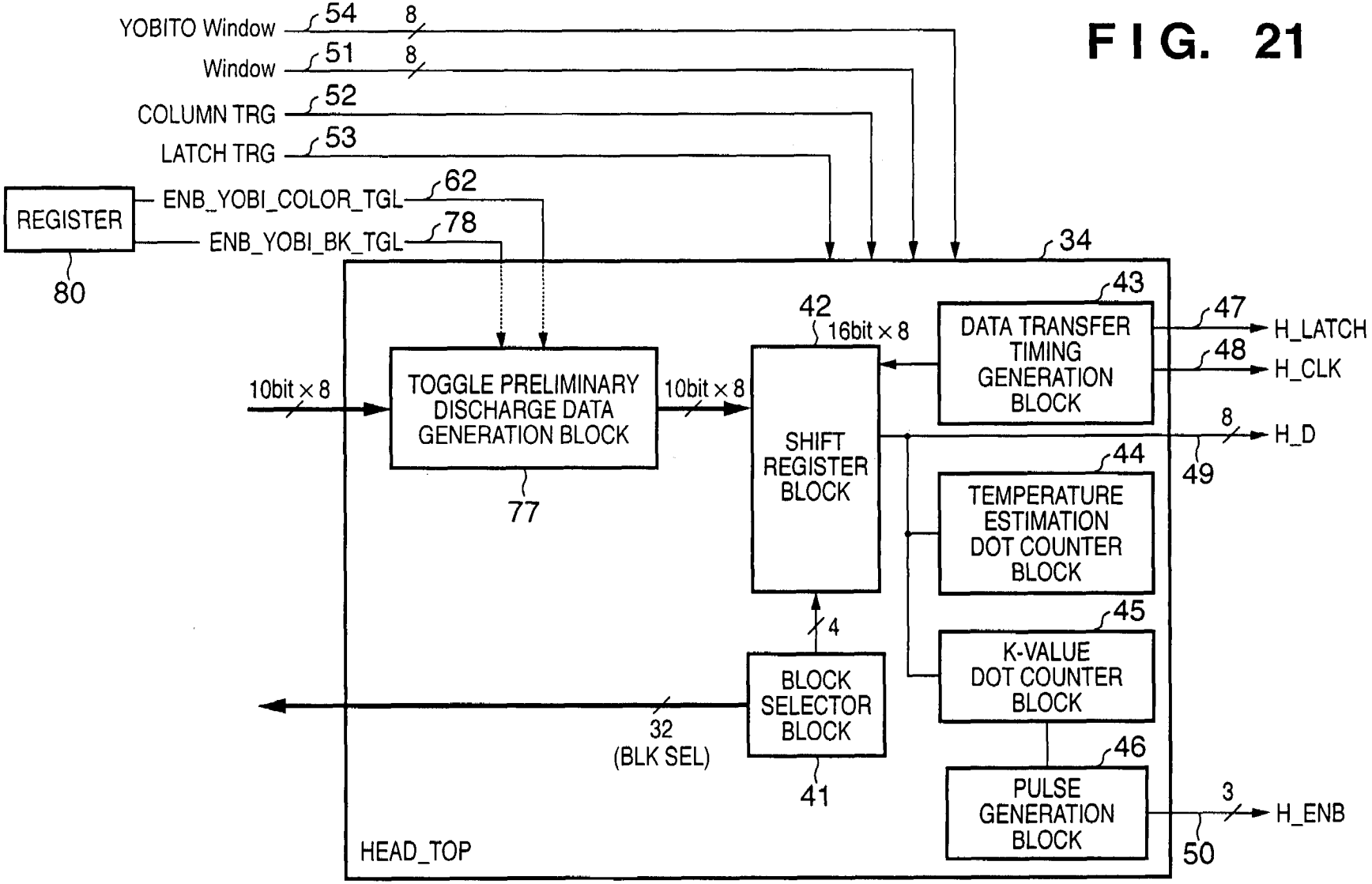
FIG. 21 is a block diagram showing a control block for implementing toggle preliminary discharge according to the embodiment of the present invention.

The register is arranged as a register 80 shown in FIG. 21 in, e.g., the printhead control block. A setting to the register allows setting which of a main or dummy nozzle is set as an end nozzle in toggle preliminary discharge.

A control block for implementing toggle preliminary discharge will be explained with reference to FIG. 21.

FIG. 21 is a block diagram showing the control block for implementing toggle preliminary discharge according to the embodiment of the present invention.

A toggle preliminary discharge data generation block 77 which implements toggle preliminary discharge is a characteristic functional block of the present invention, and exists within the printhead control block (HEAD_TOP) 34.

The toggle preliminary discharge data generation block 77 receives, as toggle preliminary discharge function enable signals, an ENB_YOBI_BK_TGL (black) signal 78 and the ENB_YOBI_COLOR_TGL (color) signal 62 from the register 80 (FIG. 20).

The toggle preliminary discharge data generation block 77 is activated using YOBITO Window 54 and Column TRG 52. As described above, Column TRG 52 is enabled only when YOBITO Window 54 is open.

A YOBI_COLOR_TGL_FLG signal (for color) which is inverted every column is generated in response to Column TRG 52. Nozzle data for performing toggle preliminary discharge is generated on the basis of a circuit implemented by the circuit description language of FIG. 19. If execution of toggle preliminary discharge is not set, nozzle data is not processed, passes through the block, and is input to the shift register block 42.

In toggle preliminary discharge, ink is alternately discharged from main and dummy nozzles at the same driving frequency on the basis of the driving principle, and the discharge counts of the main and dummy nozzles are equal to each other. To the contrary, in conventional preliminary discharge (preliminary discharge by sequentially driving main and dummy nozzles), preliminary discharge by main nozzles and preliminary discharge by dummy nozzles are executed at different timings. Depending on the application and purpose, the preliminary discharge counts of main and dummy nozzles can be separately controlled.

In terms of the time, toggle preliminary discharge is effective. However, in terms of the ink consumption amount, conventional preliminary discharge is effective depending on control contents. Especially when the printer 11 is left to stand for a long time (when the main nozzles of the printhead 27 may be seriously clogged), or when the printhead 27 is exchanged, it is desirable to separately control the discharge counts of main and dummy nozzles and control the ink consumption amount. In this case, conventional preliminary discharge may be performed.

From this, according to the embodiment, toggle preliminary discharge is set on the basis of the result of monitoring the state of the printhead 27 of the printer 11 by the CPU 22. For example, when the printhead 27 is left to stand for a long time or is exchanged, no toggle preliminary discharge is set, and conventional preliminary discharge is performed. Once conventional preliminary discharge is executed, toggle preliminary discharge is basically set. Even while toggle preliminary discharge is set, the CPU 22 can monitor the state of the printhead 27 of the printer 11, and if necessary, cancel setting of toggle preliminary discharge and execute conventional preliminary discharge.

A flowchart showing toggle preliminary discharge operation will be described with reference to FIG. 22.

Figure 22:
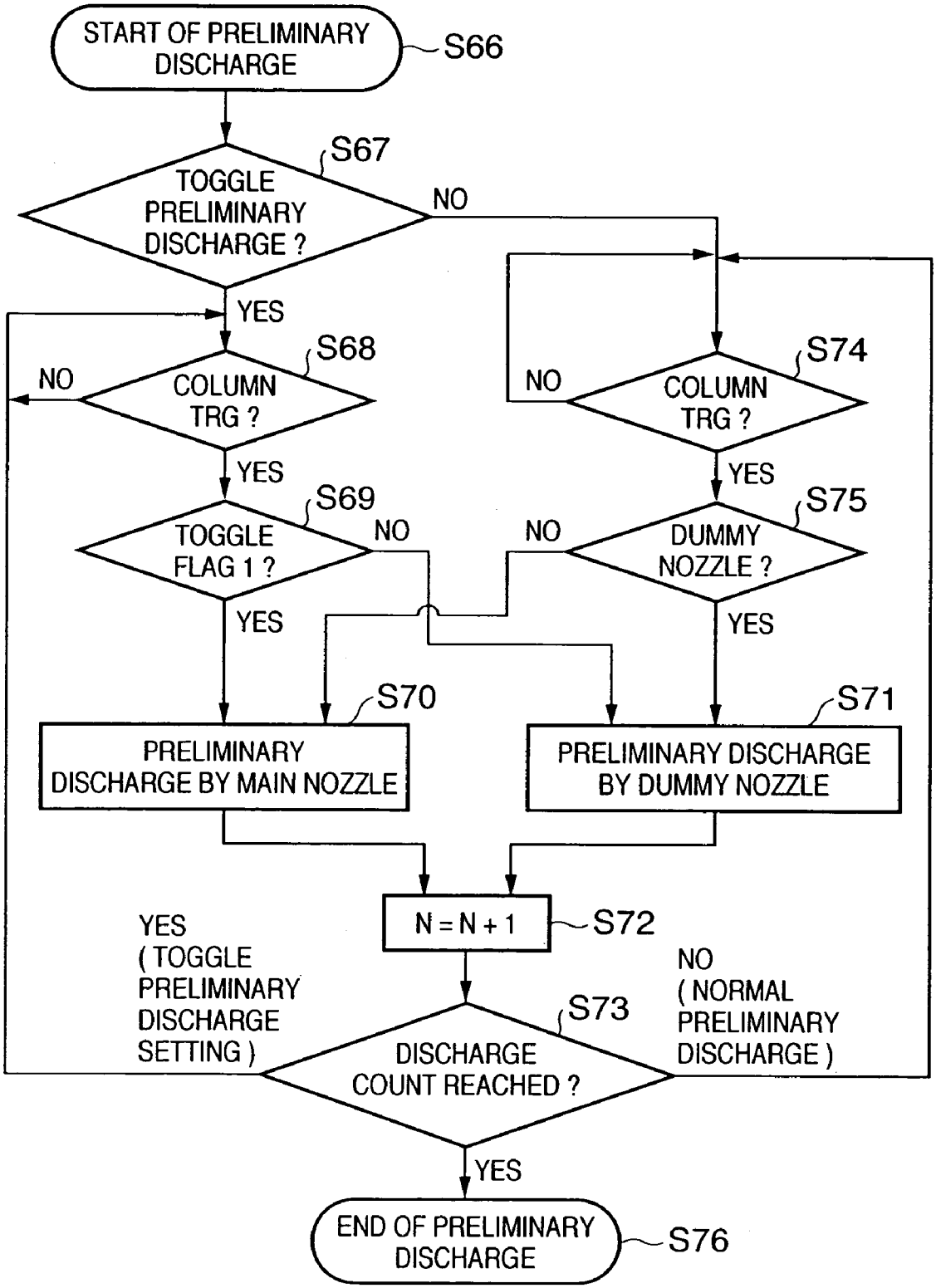
FIG. 22 is a flowchart showing toggle preliminary discharge operation according to the embodiment of the present invention.

FIG. 22 is a flowchart showing toggle preliminary discharge operation according to the embodiment of the present invention.

Toggle preliminary discharge operation is executed under the control of the CPU 22. FIG. 22 copes with either black or color printing.

When a preliminary discharge start sequence is executed in step S66, whether toggle preliminary discharge has been set is determined in step S67. If toggle preliminary discharge has been set (YES in step S67), the flow advances to step S68.

In step S68, the presence/absence of Column TRG is determined. If no Column TRG exists (NO in step S68), the flow waits until it appears. If Column TRG exists (YES in step S68), the flow advances to step S69 to determine whether Toggle Flag=1.

If Toggle Flag=1 (YES in step S69), the flow advances to step S70 to execute preliminary discharge by main nozzles. If Toggle Flag=0 (NO in step S69), the flow advances to step S71 to execute preliminary, discharge by dummy nozzles.

After execution of step S70 or S71, a preliminary discharge count N is counted in step S72, and every time discharge of one column ends, the preliminary discharge count N is incremented by one.

In step S73, the current preliminary discharge count N and a specified preliminary discharge count M are compared. If the preliminary discharge count N=the specified preliminary discharge count M, i.e., preliminary discharge at the specified preliminary discharge count ends (YES in step S73), the flow advances to step S76 to end the preliminary discharge sequence. If the preliminary discharge count N≠the specified preliminary discharge count M and toggle preliminary discharge is executed, the flow returns to step S68 and waits for the appearance of the next Column TRG.

If no toggle preliminary discharge has been set in step S67 (NO in step S67), the flow advances to step S74, and normal preliminary discharge is performed in a preliminary discharge mode by main or dummy nozzles.

In step S74, the presence/absence of Column TRG is determined. If no Column TRG exists (NO in step S74), the flow waits until it appears. If Column TRG exists (YES in step S74), the flow advances to step S75 to determine whether nozzles subjected to preliminary discharge are main or dummy nozzles.

If the target nozzles are main nozzles (NO in step S75), the flow advances to step S70 to execute preliminary discharge by main nozzles. If target nozzles are dummy nozzles (YES in step S75), the flow advances to step S71 to execute preliminary discharge by dummy nozzles.

After execution of step S70 or S71, the preliminary discharge count N is counted in step S72, and every time-discharge of one column ends, the preliminary discharge count N is incremented by one.

In step S73, the current preliminary discharge count N and the specified preliminary discharge count M are compared. If the preliminary discharge count N=the specified preliminary discharge count M, i.e., preliminary discharge at the specified preliminary discharge count ends (YES in step S73), the flow advances to step S76 to end the preliminary discharge sequence. If the preliminary discharge count N≠the specified preliminary discharge count M and normal preliminary discharge is executed, the flow returns to step S74 and waits for the appearance of the next Column TRG.

As described above, according to the embodiment, by executing toggle preliminary discharge, ink staying at the stagnation portion of the common ink chamber of the printhead can be smoothly, reliably discharged from the nozzles of the printhead. As a result, the same effects as those of conventional preliminary discharge by sequential driving of main and dummy nozzles can be obtained.

The discharge frequency of preliminary discharge can be set double the conventional one, and the entire preliminary discharge can end within half the time.

More specifically, the discharge frequency of preliminary discharge can be set double the conventional frequency by alternately performing discharge by main nozzles and dummy nozzles every column. In other words, even if the discharge frequency of preliminary discharge is doubled, preliminary discharge by main nozzles and preliminary discharge by dummy nozzles are executed every column, and the discharge frequency of each nozzle is halved and coincides with the conventional discharge frequency. The total preliminary discharge time can, therefore, be shortened to half the conventional time.

In the above embodiment, droplets discharged from the printhead are ink, and a liquid contained in the ink tank is ink. However, the content of the ink tank is not limited to ink. For example, the ink tank may contain a processing solution to be discharged onto a printing medium in order to increase the fixing properties, water resistance, or quality of a printed image.

Of inkjet printing systems, the embodiment can adopt a system which comprises a means (e.g., an electrothermal transducer or laser beam) for generating thermal energy as energy utilized to discharge ink and changes the ink state by thermal energy. This inkjet printing system can increase the printing density and resolution.

A full line type printhead having a length corresponding to the width of the maximum printing medium printable by the printing apparatus can take a structure which meets this length by a combination of printheads as disclosed in the above-mentioned specification, or a single integrated printhead structure.

It is also possible to employ a cartridge type printhead described in the embodiment in which an ink tank is integrated with a printhead itself, or an interchangeable chip type printhead which can be electrically connected to the apparatus main body and receive ink from the apparatus main body when attached to the apparatus main body.

It is preferable to add a printhead recovery means or preliminary means to the printing apparatus because printing operation can be further stabilized. Practical examples of these means are a capping means for the printhead, a cleaning means, a pressurizing or suction means, an electrothermal transducer, another heating element, and a preliminary heating means as a combination of the electrothermal transducer and heating element. A preliminary discharge mode in which discharge is performed independently of printing is also effective for stable printing.

The printing mode of the printing apparatus is not limited to a printing mode using only a main color such as black. The apparatus can adopt at least either a composite color mode using different colors or a full color mode using a color mixture, regardless of whether the printhead is an integral printhead or a combination of printheads.

In addition, the printing apparatus according to the present invention can take the form of any of an integrated or separate image output terminal of an information processing apparatus such as a computer, a copying apparatus combined with a reader or the like, and a facsimile apparatus having a transmission/reception function.

Note that the present invention can be applied to an apparatus comprising a single device or to system constituted by a plurality of devices.

Furthermore, the invention can be implemented by supplying a software program, which implements the functions of the foregoing embodiments, directly or indirectly to a system or apparatus, reading the supplied program code with a computer of the system or apparatus, and then executing the program code. In this case, so long as the system or apparatus has the functions of the program, the mode of implementation need not rely upon a program.

Accordingly, since the functions of the present invention are implemented by computer, the program code installed in the computer also implements the present invention. In other words, the claims of the present invention also cover a computer program for the purpose of implementing the functions of the present invention.

In this case, so long as the system or apparatus has the functions of the program, the program may be executed in any form, such as an object code, a program executed by an interpreter, or scrip data supplied to an operating system.

Example of storage media that can be used for supplying the program are a floppy disk, a hard disk, an optical disk, a magneto-optical disk, a CD-ROM, a CD-R, a CD-RW, a magnetic tape, a non-volatile type memory card, a ROM, and a DVD (DVD-ROM and a DVD-R).

As for the method of supplying the program, a client computer can be connected to a website on the Internet using a browser of the client computer, and the computer program of the present invention or an automatically-installable compressed file of the program can be downloaded to a recording medium such as a hard disk. Further, the program of the present invention can be supplied by dividing the program code constituting the program into a plurality of files and downloading the files from different websites. In other words, a WWW (World Wide Web) server that downloads, to multiple users, the program files that implement the functions of the present invention by computer is also covered by the claims of the present invention.

It is also possible to encrypt and store the program of the present invention on a storage medium such as a CD-ROM, distribute the storage medium to users, allow users who meet certain requirements to download decryption key information from a website via the Internet, and allow these users to decrypt the encrypted program by using the key information, whereby the program is installed in the user computer.

Besides the cases where the aforementioned functions according to the embodiments are implemented by executing the read program by computer, an operating system or the like running on the computer may perform all or a part of the actual processing so that the functions of the foregoing embodiments can be implemented by this processing.

Furthermore, after the program read from the storage medium is written to a function expansion board inserted into the computer or to a memory provided in a function expansion unit connected to the computer, a CPU or the like mounted on the function expansion board or function expansion unit performs all or a part of the actual processing so that the functions of the foregoing embodiments can be implemented by this processing.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2003-410770 filed on Dec. 9, 2003, the entire contents of which are hereby incorporated by reference herein.

What is claimed is:

1. A printing apparatus which drives and controls a printhead for discharging a liquid from main nozzles and printing on a printing medium, the printhead having a common liquid chamber which receives a liquid, a plurality of main nozzles which are aligned at a predetermined interval along a longitudinal direction of the common liquid chamber and which are used for printing, a plurality of dummy nozzles which are aligned on two sides of the main nozzles along an array direction of the main nozzles and which are not used for printing, and a plurality of liquid chambers which communicate with the common liquid chamber while the main nozzles and the dummy nozzles communicate with the liquid chambers, comprising:

preliminary discharge means for performing preliminary discharge from the main nozzles and the dummy nozzles in order to establish a good discharge state of the liquid from the main nozzles;

switching means for alternately switching between the main nozzles and the dummy nozzles; and control means for executing and controlling, as the preliminary discharge performed by said preliminary discharge means, a toggle preliminary discharge operation of alternately performing discharge from the main nozzles and the dummy nozzles every column for a plurality of successive columns.

2. The apparatus according to claim 1, wherein a driving frequency of the toggle preliminary discharge operation is double a preliminary discharge frequency of each of the main nozzles and the dummy nozzles.

3. The apparatus according to claim 1, wherein one of the main nozzles and the dummy nozzles can be selected as an end nozzle in the toggle preliminary discharge operation.

4. The apparatus according to claim 1, wherein in the toggle preliminary discharge operation, printing data for performing preliminary discharge from the dummy nozzles includes zero data.

5. The apparatus according to claim 1, wherein said switching means is implemented by hardware.

6. The apparatus according to claim 1, wherein the printhead includes an inkjet printhead which prints by discharging ink.

7. The apparatus according to claim 6, wherein the printhead includes a printhead which discharges ink by utilizing thermal energy, and comprises a thermal transducer which generates thermal energy to be applied to ink.

8. The printing apparatus according to claim 1, wherein said plurality of main nozzles is aligned on two sides of the common liquid chamber along the longitudinal direction of the common liquid chamber.

9. A method of controlling a printing apparatus which drives and controls a printhead for discharging a liquid from main nozzles and printing on a printing medium, the printhead having a common liquid chamber which receives a liquid, a plurality of main nozzles which are aligned at a predetermined interval along a longitudinal direction of the common liquid chamber and which are used for printing, a plurality of dummy nozzles which are aligned on two sides of the main nozzles along an away direction of the main nozzles and which are not used for printing, and a plurality of liquid chambers which communicate with the common liquid chamber while the main nozzles and the dummy nozzles communicate with the liquid chambers, comprising:

a preliminary discharge step of performing preliminary discharge from the main nozzles and the dummy nozzles in order to establish a good discharge state of the liquid from the main nozzles;

a switching step of alternately switching between the main nozzles and the dummy nozzles; and a control step of executing and controlling, as the preliminary discharge performed in the preliminary discharge step, a toggle preliminary discharge operation of alternately performing discharge from the main nozzles and the dummy nozzles every column for a plurality of successive columns.

10. The method according to claim 9, wherein said plurality of main nozzles is aligned on two sides of the common liquid chamber along the longitudinal direction of the common liquid chamber.

11. A control circuit for a printhead for discharging a liquid from main nozzles and printing on a printing medium, the printhead having a common liquid chamber which receives a liquid, a plurality of main nozzles which are aligned at a predetermined interval along a longitudinal direction of the common liquid chamber and which are used for printing, a plurality of dummy nozzles which are aligned on two sides of the main nozzles along an array direction of the main nozzles and which are not used for printing, and a plurality of liquid chambers which communicate with the common liquid chamber while the main nozzles and the dummy nozzles communicate with the liquid chambers, comprising:

switching means for alternately switching between the main nozzles and the dummy nozzles; and control means for executing and controlling a toggle preliminary discharge operation of alternately performing discharge from the main nozzles and the dummy nozzles every column for a plurality of successive columns, as a preliminary discharge operation of performing preliminary discharge from the main nozzles and the dummy nozzles by using said switching means in order to establish a good discharge state of the liquid from the main nozzles.

12. The control circuit according to claim 11, wherein said plurality of main nozzles is aligned on two sides of the common liquid chamber along the longitudinal direction of the common liquid chamber.

13. A method of driving a printhead for discharging a liquid from main nozzles and printing on a printing medium, the printhead having a common liquid chamber which receives a liquid, a plurality of main nozzles which are aligned at a predetermined interval along a longitudinal direction of the common liquid chamber and which are used for printing, a plurality of dummy nozzles which are aligned on two sides of the main nozzles along an array direction of the main nozzles and which are not used for printing, and a plurality of liquid chambers which communicate with the common liquid chamber while the main nozzles and the dummy nozzles communicate with the liquid chambers, comprising:

a switching step of alternately switching between the main nozzles and the dummy nozzles; and a control step of executing and controlling a toggle preliminary discharge operation of alternately performing discharge from the main nozzles and the dummy nozzles every column for a plurality of successive columns, as a preliminary discharge operation of performing preliminary discharge from the main nozzles and the dummy nozzles in the switching step in order to establish a good discharge state of the liquid from the main nozzles.

14. The method according to claim 13, wherein said plurality of main nozzles is aligned on two sides of the common liquid chamber along the longitudinal direction of the common liquid chamber.

* * * * *

UNITED STATES PATENT AND TRADEMARK OFFICE

CERTIFICATE OF CORRECTION

PATENT NO. : 7,252,362 B2
APPLICATION NO. : 11/002949
DATED : August 7, 2007
INVENTOR(S) : Katsu et al.

It is certified that error appears in the above-identified patent and that said Letters Patent is hereby corrected as shown below:

COLUMN 17:
Line 9, “preliminary,” should read --preliminary--.

COLUMN 20:
Line 50, claim 9 “away” should read --array--.

Signed and Sealed this

Tenth Day of March, 2009

JOHN DOLL
*Acting Director of the United States Patent and Trademark Office*